US010052003B2

(12) United States Patent
Schultink et al.

(10) Patent No.: US 10,052,003 B2
(45) Date of Patent: Aug. 21, 2018

(54) METHOD FOR OPTIMIZING A DEVICE FOR VACUUM CLEANING WITH A HAND-HELD, COMPACT, OR UPRIGHT VACUUM CLEANER AND BAG FILTER

(71) Applicant: Eurofilters N.V., Overpelt (BE)

(72) Inventors: Jan Schultink, Hechtel-Eksel (BE); Ralf Sauer, Overpelt (BE)

(73) Assignee: Eurofilters N.V., Overpelt (BE)

( * ) Notice: Subject to any disclaimer, the term of this patent is extended or adjusted under 35 U.S.C. 154(b) by 937 days.

(21) Appl. No.: 14/386,690

(22) PCT Filed: Feb. 21, 2013

(86) PCT No.: PCT/EP2013/053463
§ 371 (c)(1),
(2) Date: Sep. 19, 2014

(87) PCT Pub. No.: WO2013/143790
PCT Pub. Date: Oct. 3, 2013

(65) Prior Publication Data

US 2015/0067980 A1 Mar. 12, 2015

(30) Foreign Application Priority Data

Mar. 27, 2012 (EP) ..... 12002205

(51) Int. Cl.
*A47L 9/00* (2006.01)
*A47L 9/14* (2006.01)
(Continued)

(52) U.S. Cl.
CPC ..... *A47L 9/1427* (2013.01); *A47L 9/14* (2013.01); *A47L 9/22* (2013.01); *A47L 9/28* (2013.01);
(Continued)

(58) Field of Classification Search
CPC . A47L 9/00; A47L 9/14; A47L 9/1427; A47L 9/22
See application file for complete search history.

(56) References Cited

U.S. PATENT DOCUMENTS 2,699,838 A 1/1955 Holm-Hansen
4,894,881 A 1/1990 Palmer et al.
(Continued)

FOREIGN PATENT DOCUMENTS

CN 103 8582 A 1/1990
CN 115 9313 A 9/1997
(Continued)

OTHER PUBLICATIONS

AEA Energy & Environment et al.; Work on Preparatory Studies for Eco-Design Requirements of EuPs (II)—Lot 17 Vacuum Cleaners Final Report—Report to European Commission; ED 04902, Issue 1; Feb. 2009; XP055036850.
(Continued)

*Primary Examiner* — Michael Jennings
(74) *Attorney, Agent, or Firm* — Brinks Gilson & Lione

(57) ABSTRACT

The invention relates to a method for optimizing a vacuum cleaning system comprising a substantially hoseless and tubeless vacuum cleaning device and a filter bag, where the substantially hoseless and tubeless vacuum cleaning device comprises a motor-fan unit having a characteristic motor-fan curve, a filter bag receptacle, a connection port for the filter bag and a cleaning head, and where the filter bag comprises filter material made of nonwoven material, comprising the step of: adapting the characteristic motor-fan curve and the size, the shape and the material of the filter bag and the size and the shape of the filter bag receptacle and the inner diameter of the connection port for the filter bag and the cleaning head to each other such that the vacuum cleaning system achieves an efficiency of at least 30%, preferably of
(Continued)

at least 34%, particularly preferably of at least 38% when vacuuming according to the Standard on a Standard carpet type Wilton with an empty filter bag, where vacuuming according to the Standard is performed according to Standard EN 60312 and the Standard carpet type Wilton is provided according to Standard EN 60312. The Invention furthermore relates to a vacuum cleaning system having a substantially hoseless and tubeless vacuum cleaning device and a filter bag which is developed and/or manufactured using this method.

21 Claims, 27 Drawing Sheets

(51) Int. Cl.
*A47L 9/22* (2006.01)
*A47L 9/28* (2006.01)

(52) U.S. Cl.
CPC ..... *A47L 9/2868* (2013.01); *Y10T 29/49716* (2015.01)

(56) References Cited

U.S. PATENT DOCUMENTS

2002/0011051 A1* 1/2002 Schultheib et al. ..... B01D 39/1623 55/382
2005/0106355 A1* 5/2005 Kohlman et al. .. D06B 11/0059 428/85
2008/0222837 A1* 9/2008 Kaffenberger ..... A47L 9/22 15/319
2011/0047945 A1* 3/2011 Schultink ..... A47L 9/102 55/368
2011/0162335 A1* 7/2011 Frei ..... A47L 5/36 55/372

FOREIGN PATENT DOCUMENTS

| | | | |
|---|---|---|---|
| DE | 14 28 489 | A1 | 12/1968 |
| DE | 3 217 240 | A1 | 11/1982 |
| DE | 85 06 818 | U1 | 7/1986 |
| DE | 20 2005 000 917 | U1 | 4/2005 |
| DE | 20 2008 016 300 | U1 | 4/2009 |
| DE | 10 2008 006 769 | A1 | 8/2009 |
| EP | 0 289 709 | A1 | 11/1988 |
| EP | 0 529 805 | A2 | 3/1993 |
| EP | 1 254 691 | A1 | 11/2002 |
| EP | 1 795 247 | A1 | 6/2007 |
| EP | 2 263 507 | A1 | 12/2010 |
| EP | 2 366 319 | A1 | 9/2011 |
| EP | 2 366 320 | | 9/2011 |
| EP | 2 366 321 | A1 | 9/2011 |
| EP | 2 428 151 | A1 | 3/2012 |
| JP | 56 132926 | A | 10/1981 |
| JP | 2001 204661 | A | 7/2001 |
| WO | WO 2000/00269 | A1 | 1/2000 |
| WO | WO 2012/031734 | A2 | 3/2012 |

OTHER PUBLICATIONS

British Standard EN 60312; "Vacuum cleaners for household use—Methods of measuring the performance"; English version; European Committee for Electrotechnical Standardization; Feb. 2008; 80 pages.

* cited by examiner detail 02 detail 10 detail 11 detail 08 detail 09 detail 14

METHOD FOR OPTIMIZING A DEVICE FOR VACUUM CLEANING WITH A HAND-HELD, COMPACT, OR UPRIGHT VACUUM CLEANER AND BAG FILTER

FIELD OF THE INVENTION

This application claims the benefit under 35 U.S.C. § 371 of International Application No. PCT/EP2013/053463, filed Feb. 21, 2013, which claims the benefit of European Patent Application No. 12002205.8, filed Mar. 27, 2012, which are incorporated by reference herein in their entirety.

The invention relates to a method for optimizing a vacuum cleaning system comprising a substantially hoseless and tubeless vacuum cleaning device and a filter bag, wherein the vacuum cleaning device comprises a motor-fan unit having a characteristic motor-fan curve, a filter bag receptacle, a connection port for the filter bag and a cleaning head, and wherein the filter bag comprises filter material made of nonwoven material. The invention further relates to a vacuum cleaning system in which such a method is employed for optimization in the development and/or manufacture of the latter.

STANDARDS AND DEFINITIONS USED

Standard EN 60312:

References in the following description and the claims shall relate to standard EN 60312 exclusively in the version: DRAFT DIN EN 60312-1 "Vacuum cleaners for household use—Dry vacuum cleaners—Methods for measuring the performance (Staubsauger für den Hausgebrauch-Trockensauger-Prüfverfahren zur Bestimmung der Gebrauchseigenschaften) (IEC 59F/188/CDV:2009): German version EN 60312-1:2009 with a release date of Dec. 21, 2009.

Substantially Hoseless and Tubeless Vacuum Cleaning Device:

The term substantially hoseless and tubeless vacuum cleaning device is presently used to distinguish from the so-called floor vacuum cleaning device which is a housing that is movable on the ground on rollers and/or skids and in which a motor-fan unit and the dust collection chamber are located. The housing is in such a floor vacuum cleaning device connected via a long hose to a long tube at the end of which the suction nozzle is attached, usually in the form of an exchangeable cleaning head. These floor vacuum cleaning devices are not the subject matter of the present invention. The lengths of the hose and the tube are in such floor vacuum cleaning devices typically in the range of 1.4 m to 1.9 m for the hose and of 0.6 m to 1.0 m for the tube. A typically curved intermediate member in the form of a carry handle is located between the hose and the tube. This intermediate member has a typical length of 0.3 m to 0.4 m. In the floor vacuum cleaning device, the tube shall also be referred to as a suction tube and the hose as a suction hose.

An example of a substantially hoseless and tubeless vacuum cleaning device covered by the present invention, however, is the hand-held vacuum cleaning device (or also hand vacuum cleaner). It is comprised of a housing with a motor-fan unit and the filter bag receptacle with a filter bag. There is a handle located at one end of the housing. At its other end, a cleaning head is exchangeably attached via a very short tube. When vacuuming the floor, the housing together with the cleaning head is moved to and fro and only the base plate and the wheels of the cleaning head touch the floor. Such an arrangement does not require any hose and long tube; typically the tubes or connecting tubes used in such devices are no longer than 0.4 m).

Further substantially hoseless and tubeless vacuum cleaning devices covered by the present invention belong to the group of upright vacuum cleaning devices.

The upright vacuum cleaner is a combination of a base member with a cleaning head, which frequently comprises an electrically driven brush roll, and an upper member in which the dust collection container is provided. The cleaning head is not exchangeable and is via a hose and/or a tube connected to the dust collection container. This tube and this hose are in upright vacuum cleaners also referred to as connecting tube and connecting hose. The motor-fan unit can be arranged in the base member or the upper member. Covered by the invention are now upright vacuum cleaning devices in which the overall length of the hose and/or the tube is less than 0.5 m. In particular, when the filter bag is provided upside-down (i.e. with an opening towards the bottom), then the connection of the hose and/or the tube between the cleaning head and the filter bag can be designed very short (<0.3 m).

Upright vacuum cleaners of the group whose overall length of hose and/or tube is greater than 0.5 m, however, are no subject matter of the present invention.

Another example of an almost hoseless and almost tubeless vacuum cleaning device covered by the present invention is the compact vacuum cleaner. It is comprised by a housing with motor-fan unit and a filter bag receptacle and a filter bag which is placed directly on the cleaning head or is integrated into the cleaning head, respectively. This housing is connected with a shaft to a handle.

Motor-Fan Unit:

A motor-fan unit terms the combination of an electric motor with a single- or multi-stage fan. The two components are commonly mounted on a common axis and adapted optimally to each other in terms of performance.

Air Flow, Negative Pressure, Suction Power, Air Flow Curve (Air Data):

For determining this so-called air data, the substantially hoseless and tubeless vacuum cleaning device with a filter bag is measured according to EN 60312 (see in particular EN 60312, Section 5.8 Air data). The hand-held vacuum cleaning device is without the cleaning head connected directly to a measuring box using an adapter, as described in EN 60312, Section 7.2.7. The upright vacuum cleaner and the compact vacuum cleaner are connected to the cleaning head, therefore like a brush vacuum cleaner, as described in Section 5.8.1 of EN 60312.

FIG. 1*a* shows how a hand-held vacuum cleaning device according to the present invention is to be connected to the measuring box. FIG. 1*b* to FIG. 1*e* are technical drawings of a specific configuration of the connection to the measuring box, which are suitable for direct reproduction. In addition to this configuration, any other configurations are possible, provided that the internal dimensions for the air ducts are not changed (for example, the radius of 20 mm in FIG. 1*b* "detail 02" or the inner diameter of the connection member in FIG. 1*c* "detail 05).

FIG. 1*i* and FIG. 1*j* show a schematic representation of the adapter as used for the hand-held vacuum cleaning device Vorwerk VK140 known from prior art. The adapter member being shown in FIG. 1J is via the adapter member being shown in FIG. 1*b* connected to the measuring box. It is to be mentioned for the adapter according to FIG. 1*i* that the inner diameter of the tubular member is 33 mm.

Furthermore, both drawings also show the suction port for filling the vacuum cleaning system according to the Standard (see below section "Filling the vacuum cleaning system according to Standard with 400 g of DMT8 Standard dust"). The inner diameter can in the case of the hand-held vacuum cleaning devices according to the invention be gathered from FIG. 1*c*. It is 16 mm for the adapter in FIG. 1*i*. For measuring the air data, this suction port is sealed in an airtight manner. In the context of the present invention, only the measuring box Alternative B (see Section 7.2.7.2, Image 20*c*) is used. The air data is determined for different orifice sizes (0 to 9) that differ in the inner diameter of their opening size (0 mm to 50 mm) (see the table in section 7.2.7.2). The different orifice sizes simulate a different load that is caused in everyday use by the cleaning head and the ground to be vacuumed.

The negative pressure h and the power input $P_1$ that result for the different orifice sizes 0 to 9 are measured.

The power input with orifice size 8 (40 mm) is in the context of the present invention measured as the electrical input power of the vacuum cleaning device. This results in values most relevant for use in practice since operation on different types of flooring is usually performed at about this throttled condition.

The average input power $P_{1m}$[W] is defined as the average value of the input power with orifice size 0 (0 mm) and orifice size 9 (50 mm).

The air flow q (in prior art also referred to as suction air flow or volume flow) is determined for each orifice size respectively from the readings for the negative pressure (see EN 60312, Section 7.2.7.). The readings possibly need to be corrected according to EN 60312, in particular with respect to the Standard air density (see EN 60312, section 7.2.7.4). The air flow curve h (q) describes the relationship between the negative pressure and the air flow of a vacuum cleaner. It is obtained by interpolation as described in EN 60312 (see EN 60312, section 7.2.7.5) of the value pairs respectively obtained for the different orifice sizes regarding the measured negative pressure and the determined air flow. The intersection with the x-axis indicates the maximum air flow achievable with the device. The negative pressure is presently 0, the device is therefore operation in an unthrottled manner.

The intersection with the y-axis indicates the maximum negative pressure $h_{max}$ achievable with the device. The air flow is equal to 0, the device is throttled to a maximum. This value is obtained with orifice size 0.

The linear interpolation prescribed in EN 60312 between measuring points for determining the air flow curve is in the case of radial fans a very good approximation and is therefore presently always used when the motor-fan unit is of the radial type. For axial and diagonal fans, however, quadratic interpolation is used analogous to Standard EN 60312.

The intersections of the air flow curve with the coordinate axes (irrespective of the selected type of interpolation) are characteristic of the fan geometry, the input power and of the flow resistances in the vacuum cleaner.

By multiplication of the air flow and the negative pressure, the characteristic curve $P_2$ for the suction power can be derived from the air flow curve (see EN 60312, Section 5.8.3, in prior art this suction power is also referred to as air flow rate). The maximum of this curve is referred to as the maximum suction power $P_{2max}$ of the vacuum cleaner. The efficiency η is calculated as the ratio of the two corresponding values (i.e. values of equal air flow) for the suction power $P_2$ and the power input $P_1$. The maximum of this curve corresponds to the maximum efficiency $\eta_{max}$ of the vacuum cleaner. The efficiency η is according to EN 60312 given in [%].

Air Flow, Negative Pressure, Suction Power, Characteristic Motor-Fan Curve (Air Data) for the Motor-Fan Unit:

The characteristic motor-fan curve describes the relationship between that air flow and the negative pressure of the motor-fan unit not being installed in the vacuum cleaning device at different throttle conditions, which is in turn simulated by the different orifice sizes. The characteristic motor-fan curve is determined analogous to the determination of the air flow curve according to EN 60312.

The motor-fan unit is for this placed directly and in an airtight manner onto the measuring box and measured with different orifice sizes 0 to 9 according to EN 60312. For the rest, this is the same procedure as for measuring the air flow curve. FIG. 1*f* to FIG. 1*g* and FIG. 1*b* are technical drawings of a specific configuration of the connection of the motor-fan unit being used in the present invention to the measuring box. The wall of the measuring box is in FIG. 1*f* marked with I. In addition to this configuration, any other configurations are possible, provided that the internal dimensions for the air ducts are not changed (the radius of 20 mm in FIG. 1*f* "detail 02" and the conical enlargement of the air duct from 35 mm to 40 mm in FIG. 1*g* "detail 10"). The motor-fan unit according to prior art, i.e. the unit of the hand-held vacuum cleaner Vorwerk VK140, is connected accordingly to the measuring box.

The negative pressure and the power input are again measured for the different orifice sizes 0 to 9. These readings are corrected if necessary (see above). The air flow for the respective orifice sizes is determined from the measured negative pressure readings. The characteristic motor-fan curve h(q) describes the relationship between the negative pressure and the air flow of the measured motor-fan unit. It is in turn obtained by linear or quadratic interpolation (depending on the motor-fan unit employed, see above) of the value pairs respectively obtained for the different orifice sizes regarding the measured negative pressure and the determined air flow. The intersection of the characteristic curve M with the x-axis presently in turn defines the maximum air flow $q_{max}$ achievable with the motor-fan unit. The negative pressure at this point is 0, the motor-fan unit is operating in an unthrottled manner. The intersection with the y-axis in turn indicates the maximum negative pressure $h_{max}$. The air flow is at this point equal to 0, the device is fully throttled (orifice size 0).

By multiplying the air flow with the negative pressure for every measuring point, the characteristic curve for the suction power $P_2$ can be derived from the characteristic motor-fan curve. The maximum of this curve is referred to as the maximum suction power $P_{2max}$ of the motor-fan unit. The efficiency η is calculated as the ratio of the two corresponding values (i.e. values of equal air flow) for the suction power $P_2$ and the power input $P_1$. The maximum of this curve corresponds to the maximum efficiency $\eta_{max}$ of the motor-fan unit. The efficiency η is according to EN 60312 given in [%].

Efficiency Reduction:

Reducing the efficiency is for the hand-held vacuum cleaner defined as the difference between the maximum efficiency of the motor-fan unit and the maximum efficiency of the vacuum cleaning system with an empty filter bag and without the cleaning head. For the compact vacuum cleaner and for the upright vacuum cleaner, the cleaning head is not separable from the device or an integrally formed component of the device. In these cases, efficiency reduction is defined as the difference between the maximum efficiency of the motor-fan unit and the maximum efficiency of the vacuum cleaning system with an empty filter bag and with the cleaning head.

Efficiency reduction is a measure for the losses of the vacuum cleaning system. Efficiency reduction is given in [%].

Vacuuming According to the Standard:

Vacuuming according to the Standard on the Standard Wilton carpet is performed as described in EN 60312, Section 5.3. Information regarding the Standard carpet type Wilton is to be found in EN 60312, Section 7.1.1.2.1 and Annex C.1 of EN 60312.

Efficiency and Suction Power when Vacuuming According to the Standard on Standard Carpet Type Wilton:

The efficiency when vacuuming according to the Standard on Standard carpet type Wilton is determined as follows:

A measurement is taken based on the dust removal measurement according to EN 60312, Section 5.3 on the Standard carpet type Wilton with the operating device according to Section 4.8. Application of the test dust is in deviation from these instructions omitted. Items 5.3.4 to 5.3.7 of EN 60312 are therefore omitted.

During measurement, the flow speed is measured in the exhaust air of the vacuum cleaner using a rotating vane anemometer type Kanomax Model 6813 with a vane probe APT275 having a diameter of 70 mm (the manufacturer of this anemometer is the company Kanomax, 219 U.S. Hwy 206, PO Box 372 Andover, N.J. 07821, www.kanomax-usa.com). The vane probe was for this purpose attached above the blow-out port of the vacuum cleaning device in a position at which the above-mentioned anemometer indicates a flow speed value that is approximately in the middle of the measurement range of the anemometer, i.e. at about 20 m/s. This serves to ensure that the flow speed of the exhaust air is in the measuring range of the anemometer. After attaching the anemometer, the value of the flow speed is accurately measured. In the case of a hand-held vacuum cleaning device, it is then connected without the cleaning head using respective adapter members to the measuring box, Alternative B, for measuring air data according to EN 60312, Section 5.8, with orifice size 8 (see FIGS. 1*i*, 1*j* and 1*b* for the hand-held vacuum cleaner Vorwerk VK 140 according to prior art and FIG. 1*a* for the hand-held vacuum cleaning devices according to the invention). In the case of a compact vacuum cleaner or an upright vacuum cleaner covered by the invention, they are connected to the measuring box like brush vacuum cleaners, as described in Section 5.8.1 of EN 60312.

The same value of the flow speed in the exhaust air of the vacuum cleaner is then set, as was measured during the dust removal measurement on the Standard carpet type Wilton. Setting the flow speed is done by respectively adjusting the operating voltage of the motor-fan unit. It is important that the position of the anemometer is not changed relative to the blow-out port as compared to the dust removal measurement. The actual position of the anemometer is presently not critical.

The negative pressure value according to EN 60312, Section 5.8.3 is measured and the air flow according to EN 60312, Section 7.2.7.2 is determined using this set-up.

This value thus obtained for the air flow is plotted to the determined air flow curve to be able to read off the corresponding negative pressure, to determine the suction power $P_2$ from the two values, and, together with the power input $P_1$ corresponding to the air flow, to determine the efficiency when vacuuming according to the Standard on the Standard carpet type Wilton.

The value for the negative pressure can also be calculated, namely in that a regression line is determined for the air flow curve and the air flow value is inserted directly into this regression equation (depending on the type of motor-fan unit, this regression equation is linear or quadratic, see above) for calculating the negative pressure (see also EN 60312, Section 7.2.7.5).

Filling the Vacuum Cleaning System According to the Standard with 400 g of DMT8 Standard Dust:

The vacuum cleaning system is filled according to the Standard with 400 g of DMT8 Standard dust in accordance with Section 5.9 of EN 60312. The adapters used for the different vacuum cleaners are shown in FIG. 1*i* (prior art) and FIG. 1*c* (invention) and described above in connection with these figures. The DMT8 Standard dust is likewise to be provided in accordance with EN 60312.

Dust Removal:

Dust removal from carpets is determined according to EN 60312, Section 5.3. The suction with a filled filter bag is determined in accordance with Section 5.9. Contrary to the termination conditions set out in Section 5.9.1.3, in principle 400 g of DMT8 dust is sucked in.

Flat Bag, Filter Bag Wall, Fold, Length, Height and Width, and Direction of a Fold, Surface Folding, Maximum Height of the Surface Folding:

The terms flat bag, filter bag wall, fold, length, height and width, and direction of a fold, surface folding, maximum height of the surface folding are in the present description and the claims used in accordance with the definitions provided in EP 2 366 321 A1.

Determining the Area of the Rectangle Corresponding to the Opening Area:

The area of the rectangle corresponding to the opening area is in the context of the present invention determined using the so-called minimum bounding rectangle that is well known from image processing (see, for example, in Tamara Ostwald. "Objekt-Identifikation anhand Regionen beschreibender Merkmale in hierarchisch partitionierten Bildern" "Aachener Schriften zur medizinischen Informatik", Volume 04, 2005.)

For determining the area of the rectangle, it is to be distinguished whether the opening area is located in a plane (two-dimensional opening area with a two-dimensional edge), or whether the opening area extends beyond a plane (three-dimensional opening area with a three-dimensional edge).

For a two-dimensional opening area, the area of the corresponding rectangle corresponding to the opening area is directly determined by the area of the minimum bounding rectangle corresponding to the two-dimensional edge of the opening area.

For a three-dimensional area, the three-dimensional edge must first be transformed into a two-dimensional edge before the area of the rectangle can be determined with a bounding rectangle For this, the edge is divided into N equal parts. With this division, N points $P_n$ (n=1, . . . , N) are defined on the three-dimensional edge. The center of gravity SP of this three-dimensional edge is then determined and the distance $d_n$ of each of the N points $P_n$ to the center of gravity is determined. This then delivers a set of points in polar coordinates $K_n$ ($d_n$; (360×n/N)°). If N is allowed to be very large, then this set of points becomes a two-dimensional edge that corresponds to the three-dimensional edge and for which a bounding rectangle can be determined. For the transformation according to the present invention, N=360 is set.

The area of the rectangle corresponding to the opening area represents a good and unambiguous approximation of the opening area of the vacuum cleaning device that can be easily determined even for complex opening areas and opening edges.

The area of a filter bag within the meaning of the present invention is determined on the filter bag when it is in an entirely unfolded state positioned flat on a support, i.e. in a two-dimensional shape. With a filter bag with non-welded side folds, the side folds are entirely folded out to determine the area. If the filter bag on the other hand comprises welded side folds, then they shall not be considered when determining the area. For example, the area of a filter bag having a rectangular shape is obtained by taking the filter bag from its packaging, completely folding it apart, measuring its length and width and multiplying them with each other.

Welded and Non-Welded Side Folds:

Flat bags within the meaning of the present invention can also comprise so-called side folds. These side folds can there be completely folded apart. A flat bag with such side folds is shown, for example, in DE 20 2005 000 917 U1 (see there FIG. 1 with side folds folded in and FIG. 3 with side folds folded apart). Alternatively, the side folds can be welded to portions of the peripheral edge. Such a flat bag is shown in DE 10 2008 006 769 A1 (cf. there in particular FIG. 1).

Usable Volume of the Filter Bag in the Receptacle, Maximum Usable Volume:

The usable volume of the filter bag in the filter bag receptacle is according to the present invention determined in accordance with EN 60312, Section 5.7.

The maximum usable volume of the filter bag is according to the present invention determined in accordance with EN 60312, Section 5.7. The only difference to EN 60312, Section 5.7 being that the filter bag is provided freely suspended in a chamber whose volume is at least large enough that the filter bag is not prevented from expanding completely to its maximum possible size when being completely filled. For example, a cube-shaped chamber satisfies this requirement having an edge length that is equal to the square root of the sum of the squares of the maximum length and the maximum width of the filter bag.

Surface of the Filter Bag, Surface of the Filter Bag Receptacle:

The surface of a filter bag within the meaning of the present invention is presently determined as twice the area assumed by the filter bag when it is in an entirely unfolded state positioned flat on a support, i.e. in a two-dimensional form. The area of the inlet opening and the area of the weld seams are not considered because they are comparatively small in relation to the actual filter area. Any folds (to increase the surface of the filter material) provided in the filter material itself are likewise not considered. The surface of a rectangular filter bag (according to above definition) therefore simply results by taking the filter bag from its packaging, completely folding it apart, measuring its length and width and multiplying them with each other and multiplying the result by two.

The surface of the filter bag receptacle within the meaning of the present invention is defined as the surface that the filter bag receptacle would have if (to the extent present) any features (ribs, rib-shaped sections, brackets, etc.) that are provided in the filter bag receptacle for the purpose of keeping the filter material of the filter bag spaced from the wall of the filter bag receptacle (which is required for smooth filter material to ensure that air can at all flow through the filter bag) are not considered. The surface of a cube-shaped filter bag receptacle with ribs therefore results as the maximum length times the maximum width times the maximum height of the filter bag receptacle without that the dimensions of the ribs presently being considered.

Since the surface of the filter bag receptacle is included only as a lower limit into the above relation, the surface of a cube-shaped body completely enclosing the filter bag receptacle can in the alternative be determined for determining whether a particular vacuum cleaning device in combination with the filter bag makes use of the above-discussed development, in particular when the filter bag receptacle is of a complex geometric shape; the surface of such a body results, for example, if one calculates the surface area of a cube with edge lengths that correspond to the maximum dimensions of the actual filter bag receptacle in the direction of the length, the width and the height (the directions of the length, the width and the height are presently of course orthogonal to each other).

PRIOR ART

Due to the scarcity of resources, it is becoming increasingly important to conserve energy in the fields of daily life, for example, in the field of household appliances such as vacuum cleaning systems. It is desirable that operation of such vacuum cleaning systems is not restricted as compared to what was previously known.

Such energy conservation requires that the vacuum cleaning systems be optimized in terms of their energy consumption, where the performance of such optimized vacuum cleaning systems, i.e. in particular dust removal, is not to be impaired.

According to prior art, the components of a vacuum cleaning system with a substantially hoseless and tubeless vacuum cleaning device and a filter bag, where the vacuum cleaning device comprises a motor-fan unit having a characteristic motor-fan curve, a filter bag receptacle and a cleaning head and where the filter bag comprises filter material made of nonwoven material are optimized such that maximum suction power according to EN 60312 is achieved for a given electrical power input, also referred to simply as power input. The devices currently available on the market that are being advertised as ecological devices with reduced input power exhibit a power input in the range of approximately 900 W.

Such an optimized vacuum cleaning system is, for example, the vacuum cleaning system Vorwerk VK 140 It can achieve dust removal according to Standard EN 60312 with a Standard carpet type Wilton of approximately 84% with an empty vacuum cleaner filter bag. It is there to be considered, however, that the good dust removal values are obtained due to the support of the cleaning head being operated by an electric motor. The power input of the cleaning head must be added to the electrical power input of the vacuum cleaner in order to be able to assess the performance and efficiency of the device.

FIG. 2*a* shows the air data for the motor-fan unit used in the vacuum cleaning system Vorwerk VK 140, FIG. 2*b* shows the air data for this vacuum cleaning system with inserted empty filter bag, and FIG. 2*c* the air data for this vacuum cleaning system with inserted filter bag filled with 400 g of DMT8 dust. These measurements were performed with the original accessories and the original filter bags supplied by Vorwerk together with this vacuum cleaner. The data collected shall below be further discussed in connection with the data for the vacuum cleaning systems according to the invention.

In view of this prior art, the invention is based on the object to optimize vacuum cleaning systems being comprised substantially of hoseless and tubeless vacuum cleaning device and filter bags such that the electrical input power of the vacuum cleaning device of the system can be significantly reduced without dust removal according to EN 60312 being adversely affected thereby.

BRIEF DESCRIPTION OF THE INVENTION

This object is satisfied by the method according to claim 1.

A method is in particular provided for optimizing a vacuum cleaning system comprising a substantially hoseless and tubeless vacuum cleaning device and a filter bag, wherein the substantially hoseless and tubeless vacuum cleaning device comprises a motor-fan unit having a characteristic motor-fan curve, a filter bag receptacle, a connection port for the filter bag and a cleaning head and wherein the filter bag comprises filter material made of nonwoven material, comprising the steps of:

adapting the characteristic motor-fan curve and the size, the shape and the material of the filter bag and the size and the shape of the filter bag receptacle and the inner diameter of the connection port for the filter bag and the cleaning head to each other such that the vacuum cleaning system achieves an efficiency of at least 30%, preferably of at least 33%, particularly preferably of at least 36% when vacuuming according to the Standard on a Standard carpet type Wilton with an empty filter bag, where vacuuming according to the Standard is performed according to Standard EN 60312 and the Standard carpet type Wilton is provided according to Standard EN 60312.

It has surprisingly been found that the power input can be significantly reduced with the optimization described above as compared with previous vacuum cleaning systems.

With an electrical input power, for example, of about 400 Watts, dust removal according to EN 60312 with the Standard carpet type Wilton of 80% can be easily achieved at a pushing force of 32 N.

With only slightly better dust removal of 84%, a Vorwerk VK140 has an electrical input power of 942 W for the vacuum cleaner and additionally about 130 W for the electric brush. The electrical input power of the vacuum cleaning system optimized with the method according to the invention can be reduced by 63% over the Vorwerk VK 140.

The method according to the invention can be further developed such that an air flow curve is first determined from the characteristic motor-fan curve and the size, the shape and the material of the filter bag and the size and the shape of the filter bag receptacle, and is adapted to the cleaning head such that a very high efficiency is achieved when vacuuming on the Standard carpet type Wilton. This development represents a particularly efficient implementation of the method previously described.

All the methods described above can also be further developed such that the adaptation additionally leads to an efficiency of at least 20%, preferably of at least 23%, particularly preferably of at least 25% arising when the vacuum cleaning system is filled according to the Standard with 400 g of DMT8 Standard dust and vacuuming on the Standard carpet type Wilton, where the DMT8 Standard dust is provided in accordance with Standard EN 60312.

It is ensured according to this development that the vacuum cleaning system also has a long service life.

All the methods described above can also be further developed to the effect that the adaptation leads to the efficiency reduction between the maximum efficiency of the motor-fan unit and the maximum efficiency of the vacuum cleaning system with an empty filter bag and without a cleaning head amounting to less than 15%, preferably to less than 13%, particularly preferably to less than 10%.

According to this development, the remaining components of the vacuum cleaning system are adapted particularly efficiently to the motor-fan unit.

According to another development, the adaptation can in all above-described methods also lead to the efficiency reduction between the maximum efficiency of the motor-fan unit and the maximum efficiency of the vacuum cleaning system with a filter bag filled with 400 g of DMT8 Standard dust and without a cleaning head amounting to less than 40%, preferably to less than 30%, particularly preferably to less than 25%.

This development is characterized by particularly efficient adaptation of the remaining components of the vacuum cleaning system to the motor-fan unit at a long service life.

In all the methods described above, the adaptation can be further developed such that it causes the suction power of the vacuum cleaning system to amount to 100 W, preferably to at least 150 W, more preferably to at least 200 W when vacuuming according to the Standard on the Standard carpet type Wilton with an empty filter bag and/or that the suction power of the vacuum cleaning system amounts to at least 70 W, preferably to at least 100 W, particularly preferably to at least 130 W when vacuuming according to the Standard on the Standard carpet type Wilton with a filter bag filled with 400 g of DMT8 Standard dust.

The values presently given have the effect that there is both a sufficient air flow as well as a sufficient negative pressure available on the Wilton to achieve good dust removal.

In addition to the previously described alternatives to the adaptation, the system can further be adapted such that the air flow when vacuuming according to the Standard on the Standard carpet type Wilton with an empty filter bag amounts to at least 20 l/s, preferably to at least 23 l/s, more preferably to at least 26 l/s and/or that the air flow when vacuuming according to the Standard on the Standard carpet type Wilton with a filter bag filled with 400 g of DMT8 Standard dust amounts to at least 20 l/s, preferably to at least 23 l/s, particularly preferably to at least 25 l/s.

If the system is adapted in such a manner, then it is ensured that a minimum input of electrical power leads to a satisfactory suction power at a long service life.

All methods previously described above can be further developed such that a filter bag in the shape of a flat bag with a first and a second filter bag wall is used, where the first and/or second filter bag wall comprises at least five folds, where the at least five folds form at least one surface folding whose maximum height prior to the first use of the filter bag in a substantially hoseless and tubeless vacuum cleaning device is less than the maximum width corresponding to the maximum height. With such a flat bag, each fold can preferably prior to the first use of the filter bag in a substantially hoseless and tubeless vacuum cleaning device have a length corresponding to at least half of the total dimension of the filter bag in the direction of the fold, preferably corresponding substantially to the total dimension of filter bag in the direction of the fold. In this, each fold of the employed flat bag can in a particularly preferred development prior to the first use of the filter bag in a substantially hoseless and tubeless vacuum cleaning device have a fold height between 3 mm and 50 mm, preferably between 5 mm and 15 mm and/or a folding width of between 3 mm and 50 mm, preferably between 5 mm and 15 mm. Such flat bags are known from EP 2 366 321 A1 and represent embodiments of flat bags that are ideal for all previously described methods according to the invention for optimizing the vacuum cleaning system at issue.

Furthermore, each surface folding of the employed filter bag can comprise portions that are located in the surface of the filter bag wall, and comprise portions that project over the surface of the filter bag wall and can be folded apart during the suction operation, where the substantially hoseless and tubeless vacuum cleaning device comprises a filter bag receptacle with rigid walls, where at least one first spacing device is provided on the walls of the filter bag receptacle such that it holds the portions of at least one surface folding located in the surface of the filter bag wall spaced from the wall of the filter bag receptacle, and at least one second spacing device is provided in such a manner that it holds the unfolded portions of the at least one surface folding spaced from the wall of the filter bag receptacle.

In the embodiment described in the last paragraph, the height of the first and/or the second spacing device relative to the wall of the filter bag receptacle can lie in a range of 5 mm to 60 mm, preferably 10 mm to 30 mm.

By providing this/these special spacing device/s for the portions of the surface folding/s located in the surface of the filter bag wall and the special spacing devices for the portions of the surface folding projecting over the surface wall, the surface folding can fold apart such that the largest part of the surface of the filter material forming the surface folding is exhibited to the flow. This increases the effective filter surface of the filter bag (as compared to the use in a conventional vacuum cleaning device), so that the dust removal ability of the filter bag can be further increased at higher separation ability and longer service life as compared to this conventional device. Such spacing devices are therefore particularly suitable for the optimization method according to the invention.

The methods described above can further be developed in that a motor-fan unit is employed whose characteristic motor-fan curve is provided such that a with orifice size 0 negative pressure of between 6 kPa and 23 kPa, preferably of between 8 kPa and 20 kPa, particularly preferably of between 8 kPa and 15 kPa and a maximum air flow of at least 50 l/s, preferably of at least 60 l/s, particularly preferably of at least 70 l/s are generated.

Motor-fan units with such a characteristic motor-fan curve have surprisingly led to vacuum cleaning system with particularly low electrical power input.

According to a further embodiment of all the methods described above, a filter bag in the shape of a flat bag can be used for optimization, and a substantially hoseless and tubeless vacuum cleaning device with a filter bag receptacle having rigid walls can be used, where the filter bag receptacle comprises an opening having a predetermined opening surface that is closeable with a flap through which the filter bag is inserted into the filter bag receptacle, and where the ratio of the rectangle corresponding to the area of an opening surface and the area of the filter bag is greater than 1.0.

If the opening area in relation to the area of the filter bag satisfies this ratio, then it is ensured that the filter bag can be introduced substantially fully unfolded into the filter bag receptacle. Any overlap of the two individual layers or any overlap of the two individual layers with themselves is thereby avoided. The largest part of the total filter surface of the filter bags is available from the beginning of the vacuuming operation (for this filter bag), and the filter characteristics of the filter bag, in particular the dust removal ability achievable with the filter bag at a high separation ability and a long service life, are therefore utilized optimally from the beginning.

According to an embodiment of all the methods for optimization described above, a filter bag in the shape of a flat bag can be used, and a substantially hoseless and tubeless vacuum cleaning device with a filter bag receptacle having rigid walls can be used, where the ratio of the usable volume of the filter bag in the filter bag receptacle to the maximum usable volume of the filter bag is greater than 0.70, preferably greater than 0.75, most preferably greater than 0.8.

If a filter bag receptacle is designed in such a way that the filter bag intended for it satisfies the conditions mentioned above, then it is ensured that during the entire vacuuming operation (until replacing the bag) the largest part of the total filter surface of the filter bag is available and the filter bag is therefore filled optimally during operation. The filter characteristics of the filter bag, in particular the dust removal ability that is achievable with the filter bag at a high separation ability and a long service life, are therefore utilized optimally until the filter bag is replaced.

Advantageously, the ratio of the surface of the filter bag receptacle and the surface of the filter bag can in the two last-mentioned embodiments be greater than 0.90, preferably greater than 0.95, particularly preferably be greater than 1.0. If the filter bag receptacle and the filter bag intended for it are designed such that this condition is satisfied, then both are adapted to each other in a particularly advantageous manner, so that the filter characteristics of the filter bag, in particular the dust removal ability that is achievable with the filter bag at a high separation ability and a long service life, are utilized optimally.

All the methods described above can be further developed such that the components are adapted to each other such that an air flow curve with an empty filter bag results in which with orifice size 0 negative pressure of between 8 kPa and 20 kPa, preferably between 8 kPa and 15 kPa, particularly preferably between 8 kPa and 13 kPa and a maximum air flow of at least 40 l/s, preferably of at least 44 l/s, particularly preferably at least 50 l/s, are generated and/or that the components are adapted to each other such that an air flow curve results with a filter bag filled with 400 g of DMT8 dust for which negative pressure with orifice size 0 of between 8 kPa and 20 kPa, preferably between 8 kPa and 18 kPa, particularly preferably of between 8 kPa 15 kPa and a maximum air flow of at least 30 l/s, preferably of at least 35 l/s, particularly preferably of at least 40 Vs are generated.

It has surprisingly shown that such optimized systems both very well remove the dust from the ground (especially on carpet) and ensure good transport of the removed dust into the vacuum cleaning system.

All methods described above can be further developed in that the inner diameter of the connection port is in the context of optimization selected such that it is larger than the smallest inner diameter of the connection of the tube and/or the hose, in particular is smaller than or equal to the largest inner diameter of the connection of the tube and/or the hose.

It is thereby prevented that the connection port additionally throttles the system, thereby reducing the air flow. An inner diameter that is larger than the largest inner diameter of the connection of the tube and/or the hose, though not being harmful, provides no further advantage.

The invention also relates to a vacuum cleaning system comprising a substantially hoseless and tubeless vacuum cleaning device and a filter bag, where the substantially hoseless and tubeless vacuum cleaning device comprises a motor-fan unit with a characteristic motor-fan curve, a filter bag receptacle, a connection port for the filter bag and a cleaning head, and where the filter bag comprises filter material of nonwoven material, where one of the methods previously described has been performed during the development and/or in the manufacture of the system.

BRIEF DESCRIPTION OF THE FIGURES

The figures serve to illustrate the measuring method employed, prior art, and the invention.

FIGS. 1*a*-1*j*: show experimental setups for measuring parameters used to describe the present invention according to and analogous to Standard EN 60312

DESCRIPTION OF THE PREFERRED EMBODIMENTS

Figure 1A:
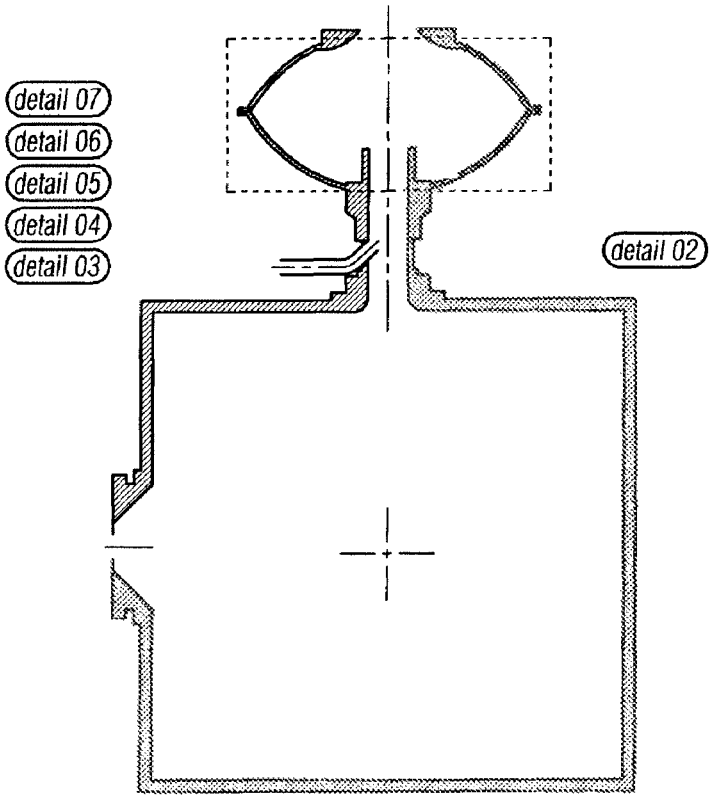
Figure 1B:
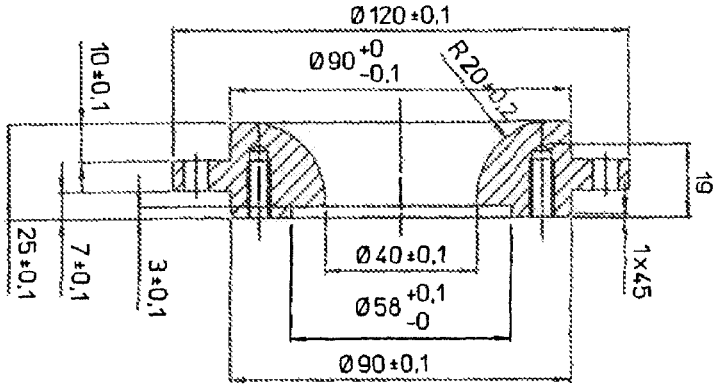
Figure 1B:
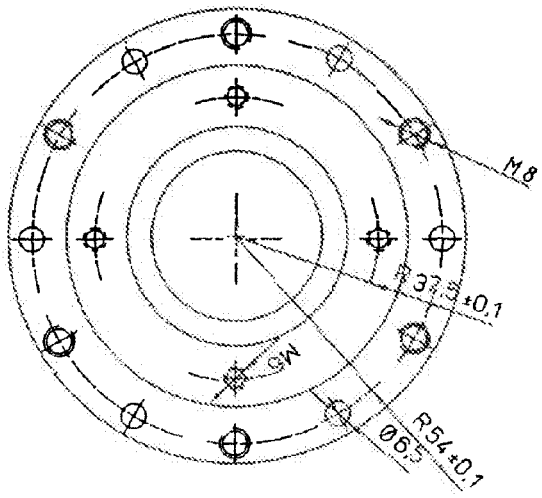

According to a first embodiment of the invention, different motor-fan units with different characteristic motor-fan curves, filter bags of different sizes, different shapes and made of different materials, differently shaped filter bag receptacles, differently shaped connection ports and different cleaning heads are combined with each other until an efficiency of at least 30%, preferably at least 33%, particularly preferably of at least 36% arises for the vacuum cleaning system when vacuuming according to the Standard on a Standard carpet type Wilson with an empty filter bag.

An air flow curve is according to a second embodiment of the invention first determined for different motor-fan units with different characteristic motor-fan curves, for different filter bags of different sizes, different shapes and made of different materials, for differently shaped filter bag receptacles, and for differently shaped connection ports. It is then adapted to different cleaning heads such that an efficiency of at least 30%, preferably of at least 33%, particularly preferably of at least 36% arises for the vacuum cleaning system when vacuuming according to the Standard on a Standard carpet type Wilson with an empty filter bag.

According a third preferred embodiment of the invention, different motor-fan units with different characteristic motor-fan curves, filter bags of different sizes, different shapes and made of different materials, differently shaped filter bag receptacles, differently shaped connection ports and different cleaning heads are combined with each other until an efficiency of at least 20%, preferably of at least 23%, particularly preferably of at least 25% arises when vacuuming according to the Standard on a Standard carpet type Wilson after the vacuum cleaning system has been filled according to the Standard with 400 g of DMT8 Standard dust.

According to further preferred embodiments of the method according to the invention, the optimization is performed such that the further optimization criteria being specified in the various dependent claims are satisfied. Any combinations of these criteria are also possible.

Particularly advantageous results of the optimization method according to the invention are presented below, i.e. particularly advantageous combinations for substantially hoseless and tubeless vacuum cleaning device with a filter bag. A particularly advantageous optimization with respect to different motor-fan units and with respect to different adaptations of filter bags to the filter bag receptacle are shown in particular. The specific optimization performed in terms of the connection port and the cleaning head shall presently not be discussed in detail. The same connection port and the same cleaning head were always used in the substantially hoseless and tubeless vacuum cleaning device presented below. These components employed have in the framework of the experiments shown to be particularly advantageous. Nevertheless, results can and could be obtained with the method according to the invention with connection ports and cleaning heads differing thereform.

1. Connection Port and Cleaning Head of the Particularly Advantageous Results of the Optimization Method According to the Invention All substantially hoseless and tubeless vacuum cleaning device presented below and obtained as a result of the optimization method according to the invention comprise a connection port as shown with its dimensions in FIG. 1*e*. The cleaning head type RD295 of the Wessel company (to be acquired from Wesselwerk GmbH, 51573 Reichshof-Wildbergerhütte) was used as a cleaning head.

2. Filter Bag and Filter Bag Receptacle of the Particularly Advantageous Results of the Optimization Method According to the Invention Two combinations of the filter bag and the filter bag receptacle as a result of the optimization method according to the invention turn out to be particularly advantageous.

These two combinations were, firstly, a flat bag without side folds and without surface foldings with an installation space adapted to it and, secondly, a flat bag with fixed surface foldings with an installation space adapted to it.

Filter material CS50 was used as filter material for both filter bags. This material is a laminate having the following structure when viewed from the flow-out side: spun-bonded nonwoven material 17 g/m$^2$, netting 8 g/m$^2$/meltblown 40 g/m$^2$/spun-bonded nonwoven material 17 g/m$^2$/PP staple fibers 50 to 60 g/m$^2$/carded staple fiber nonwoven material 22 g/m$^2$. A detailed description of the PP staple fiber layer is incidentally found in EP 1 795 247 A1. The filter material CS50 can be acquired from Eurofilters N.V. (Lieven Gevaertlaan 21, Nolimpark 1013, 3900 Overpelt, Belgium). Both the filter bags with as well as the filter bags without surface foldings have the dimensions of 290 mm×290 mm.

Figure 3:
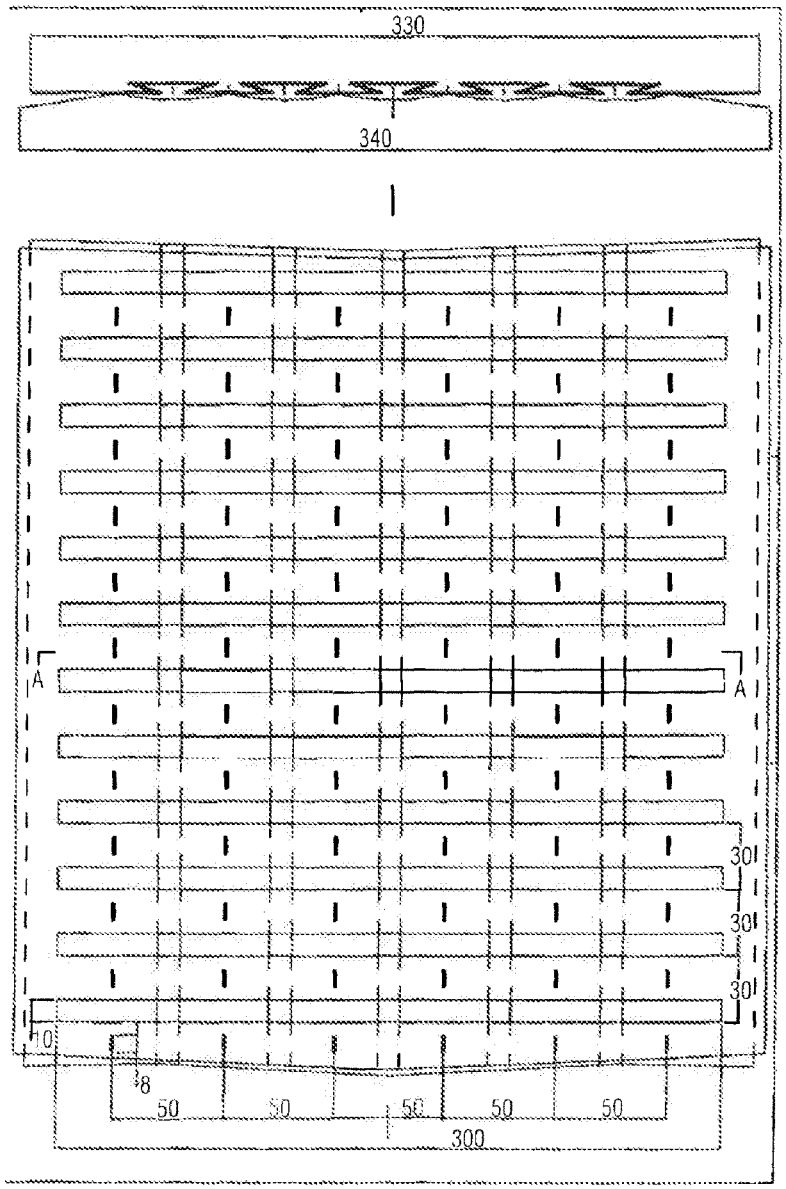
FIG. 3: shows a schematic view of a sheeting of filter material and a sheeting of nonwoven material during the production of filter material for filter bags having a surface folding in the form of fixed dovetail folds, as well as a cross-sectional view of a filter bag having a surface folding as used according to the invention where the dimensions of the surface foldings are given in [mm]

The folds of the filter bag with surface foldings were fixed in the interior of the bag using strips of nonwoven material. FIG. 3 shows how a fold fixation can be created for dovetail folds. FIG. 3 shows the top view of a sheeting of filter material comprising the dovetail folds and an overlying sheeting of nonwoven material from which ultimately the strips of nonwoven material used for fixing the folds are made. Rectangular holes of 10 mm×300 mm were punched out of the sheeting of nonwoven material (which can be made, for example, of a spun-bonded nonwoven material of 17 g/m$^2$). The illustrated cross-sectional view extends along the line A-A. It is evident from this sectional view that the portions of the sheeting of nonwoven material used for fixing the folds are connected by weld lines with the filter material sheeting. The strips of nonwoven material fixing the folds are in the cross-sectional view for the sake of better illustration shown in a somewhat exaggerated bellied manner. The nonwoven material actually lies flat on the filter material sheeting. The distances between the weld points and the distances between the punched holes as well as the sheeting widths of the filter material sheetings as well as the punched nonwoven material sheeting and the length of the welding points are In FIG. 3 denoted in [mm].

Two layers of this filter material comprised of the two sheetings are now placed onto each other and welded to each other along a width of 290 mm to form a filter bag; the remaining material of about 20 mm on each edge is cut off.

Other embodiments and explanations for fixing folds can also be found in EP 2 366 321 A1.

The filter bag with the surface foldings were fitted with diffusers. Diffusers in vacuum cleaner filter bags are well known in prior art. The variants used in the present invention are described in EP 2 263 507 A1. They were presently composed of 22 strips having a width of 11 mm and a length of 290 mm. LT75 was used as material for the diffusers. LT75 is a laminate with the following structure: spunbond nonwoven material 17 g/m$^2$/staple fiber layer 75 g/m$^2$/spunbond nonwoven material 17 g/m$^2$. The layers are ultrasonically laminated, where the laminating pattern Ungricht U4026 is used. The filter material LT75 can also be acquired from Eurofilters N.V.

The filter bag receptacle for a flat bag without surface foldings comprises a grid on its inner sides that is designed to prevent the filter material from snugly lying flat against the housing wall and no longer being able to have the air flow through. The filter bag receptacle for flat bags with surface foldings is characterized by bracket-shaped ribs which engage between the surface foldings of the filter bag in order to support the folds in folding apart. Apart from the bracket-shaped ribs, the filter bag receptacle has the same dimensions for both embodiments.

Figure 4:
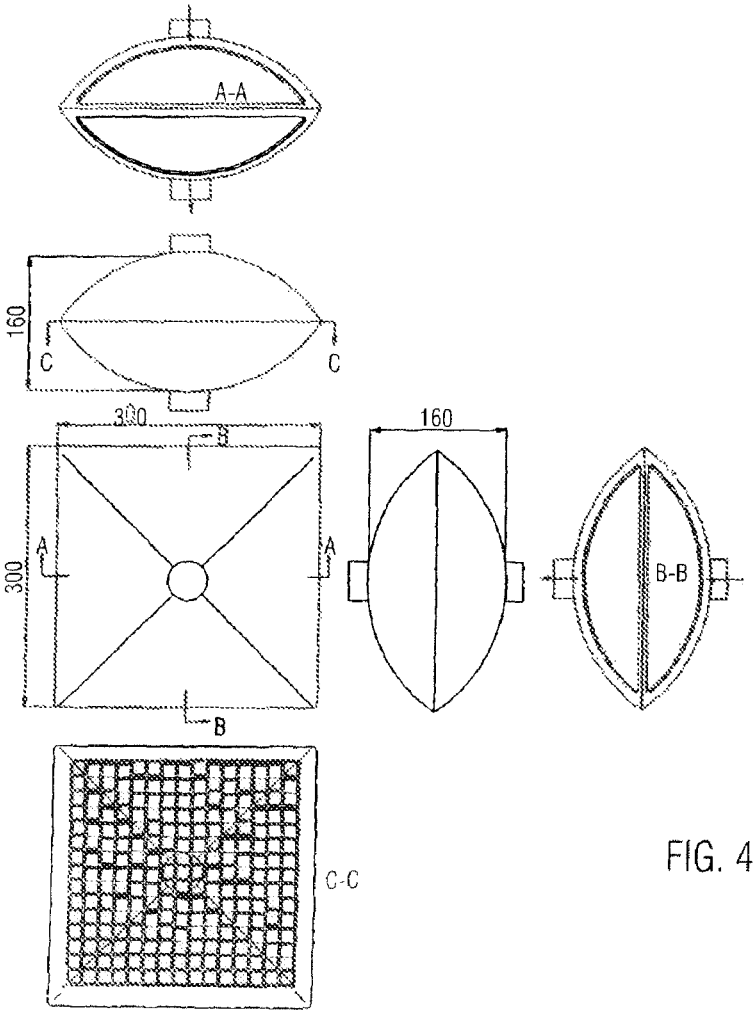
FIG. 4: shows schematic views of the filter bag receptacle for a flat bag without surface foldings as used according to the invention.

FIG. 4 shows schematic representations of the filter bag receptacle for a filter bag without surface foldings. FIG. 4 shows the filter bag receptacle in a plan view. In this plan view, it has a shape of a square with a side length of 300 mm. FIG. 4 further shows cross-sectional views along the lines A-A and B-B. As can be seen in FIG. 4, the filter bag receptacle has a maximum height of 160 mm. Other heights of the filter bag receptacle shown in FIG. 4 are specified in FIG. 7. The shape describing the inner walls of the filter bag receptacle is reminiscent of the shape of a cushion. A flat bag without surface foldings during the suction operation assumes exactly the shape of a cushion. It is in this sense also to be understood that the filter bag receptacle has a shape that corresponds approximately to the shape of the envelopment of the filled filter bag.

FIG. 4 also shows a grid. In this embodiment, the grid has a spacing to the wall of approximately 10 mm. This ensures free circulation of cleaned air in the filter bag receptacle.

Figure 5:
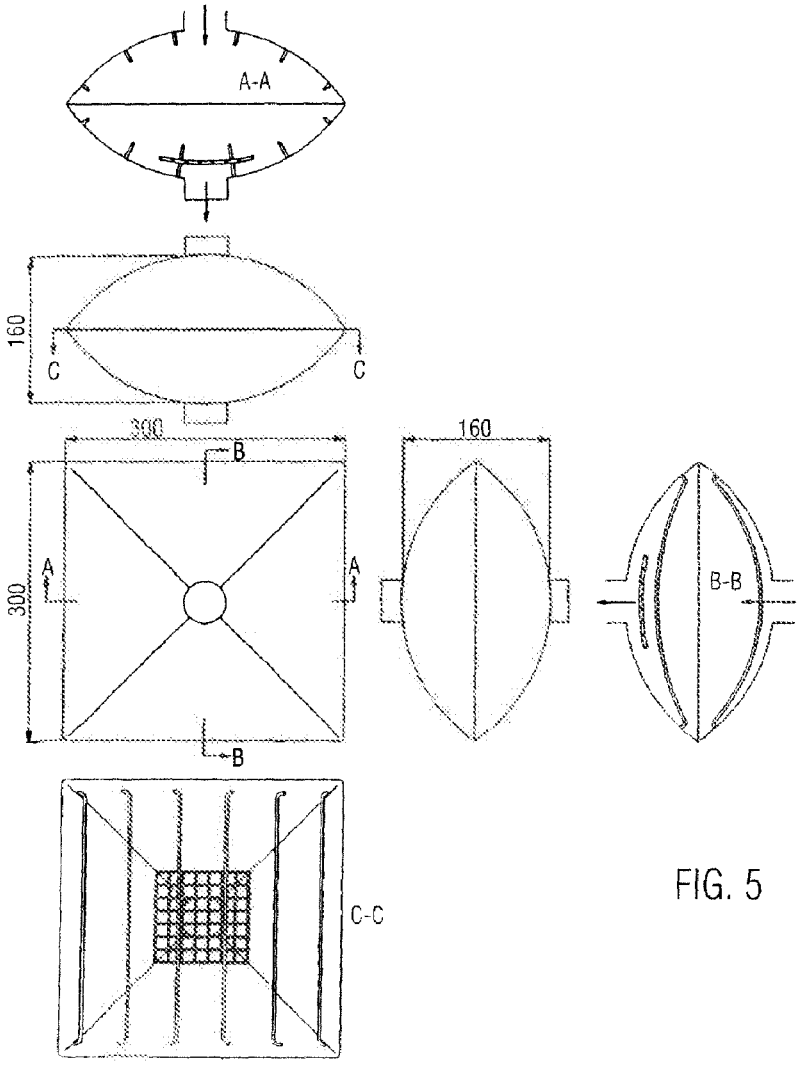
FIG. 5: shows schematic views of the filter bag receptacle for a filter bag with surface foldings as used according to the invention; only the spacer brackets adjacent to the inlet and outlet port are for the sake of clarity shown in section B-B.

FIG. 5 shows schematic representations of the filter bag receptacle for a filter bag with surface foldings. The internal dimensions of the filter bag receptacle are the same as those of the filter bag receptacle according to FIG. 4 The dimensions in FIG. 7 can to this end be referred to. A flat bag with fixed surface foldings also assumes the shape of a cushion during the suction operation, so that the filter bag receptacle has a shape that corresponds approximately to the shape of the envelopment of the filled filter bag.

Instead of a grid (as in the case of flat bags without surface foldings, see FIG. 4), the filter bag receptacle (for flat bags with surface foldings) comprises bracket-shaped ribs of different heights. In this embodiment, a device in the shape of a small grid is further provided in the region of the outlet port, which prevents the filter bag from being sucked into the outlet port due to the suction flow in the same.

Figure 6:
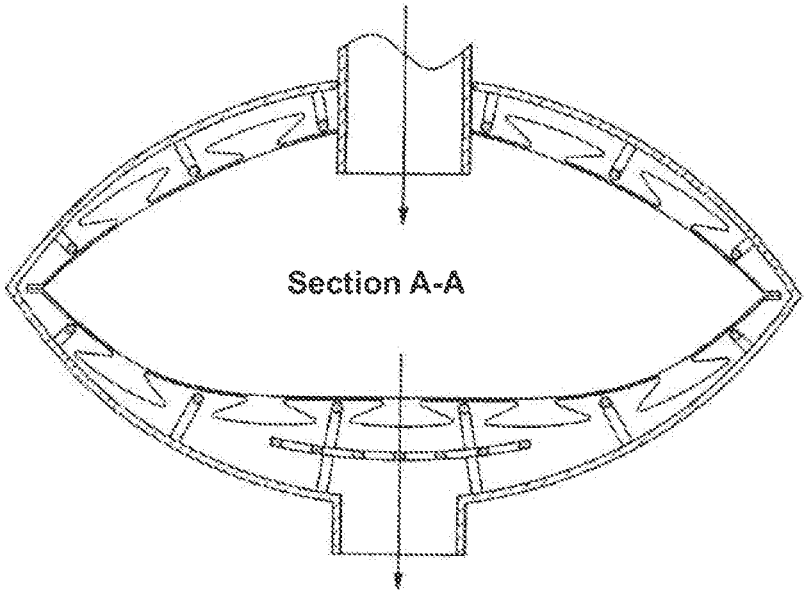
FIG. 6: shows a schematic view of the filter bag receptacle for a filter bag with surface foldings as used according to the invention and corresponds to the sectional view A-A in FIG. 5 with a filter bag inserted.

FIG. 6 corresponds to the sectional view A-A of FIG. 5, where a filter bag with fixed surface foldings in the form of dovetail folds is inserted. The bracket-shaped ribs engage between the surface foldings of the filter bag and thereby contribute to the surface foldings folding apart. This is shown schematically in FIG. 6. Simultaneously, the filter bag wall is held spaced from the wall of the filter bag receptacle, so as to ensure a air flow through the entire filter surface of the filter bag. As can be seen in FIG. 6, the bracket-shaped ribs have a height from the outside to the inside of 10 mm, of 15 mm and of 15 mm on the side facing away from the grid, and from the outside to the inside on the side facing the grid have a height of 10 mm. 20 mm and 35 mm. Free circulation of the cleaned air in the filter bag receptacle is ensured due to the ribs being perforated.

FIG. 6 further shows the wall of the filter bag receptacle. The inserted filter bag has several surface foldings that are illustrated schematically as being partially folded apart. The air to be cleaned is sucked through the inlet port (indicated by the arrow into the filter bag receptacle) into the filter bag and sucked away via the outlet of the filter bag receptacle (indicated by the arrow out of the filter bag receptacle). The grid preventing the filter bag from blocking the outlet port is located in front of the outlet port.

FIG. 4, FIG. 5, FIG. 6 and FIG. 7 only schematically illustrate the inlet and the outlet ports. The exact dimensions of the inlet and the outlet port of the filter bag receptacle result from FIG. 9*b* to FIG. 9*f*.

Figure 7:
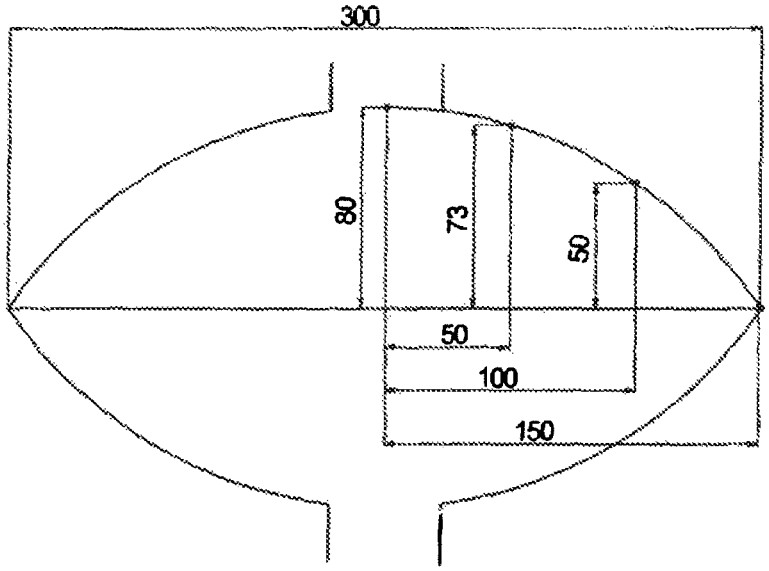
FIG. 7: shows a view of the filter bag receptacle for the preferred embodiments according to FIG. 4 and FIG. 5, in which the dimensions for this filter bag receptacle are given; the spacer brackets have been omitted for the sake of clarity.

A model exactly reproducing the dimensions of the filter bag receptacle according to FIG. 4, FIG. 5 and FIG. 7 can be acquired from Eurofilters N.V.

Figure 8:
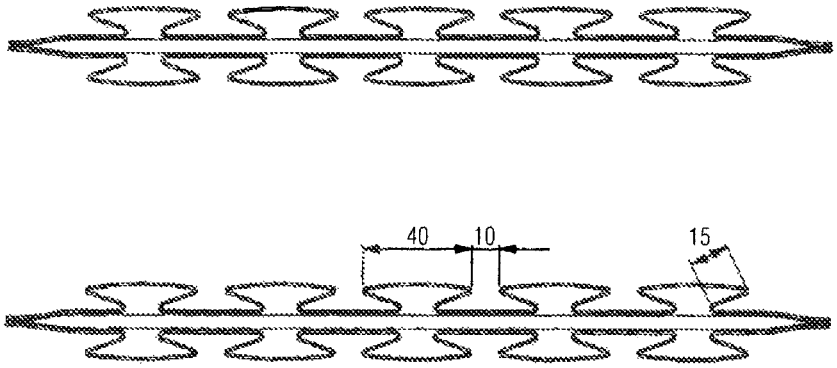
FIG. 8: shows a cross-sectional view of the filter bag with surface foldings employed according to the invention and a cross-sectional view thereof with dimensions.

FIG. 8 shows a cross-sectional view of the filter bag used in the invention with surface foldings and a cross-sectional view thereof with dimensions.

Figure 10A:
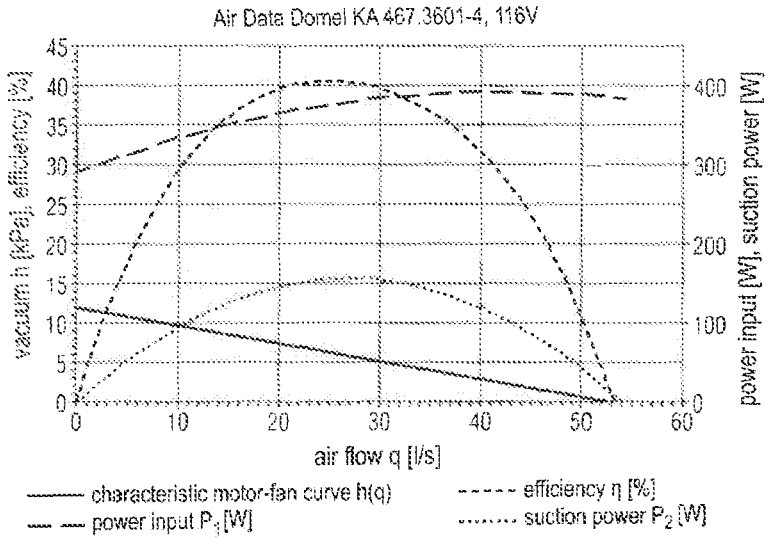
FIG. 10*a*-10*c*: show air data for a motor-fan unit and an embodiment of the substantially hoseless and tubeless vacuum cleaning device that results from the application of the method according to the invention.

3. Motor-Fan Unit of the Particularly Advantageous Results of the Optimization Method According to the Invention The motor-fan unit model Domel KA 467.3.601-4 (to be acquired from Domel, d.o.o Otoki 21, 4228 elezniki, Slovenija) is used as a motor-fan unit. Motor-fan units with different average power inputs were simulated by controlling the mains voltage using a transformer. FIG. 10A by way of example shows the air data for the motor-fan unit having an average power input of 340 W.

Figure 2A:
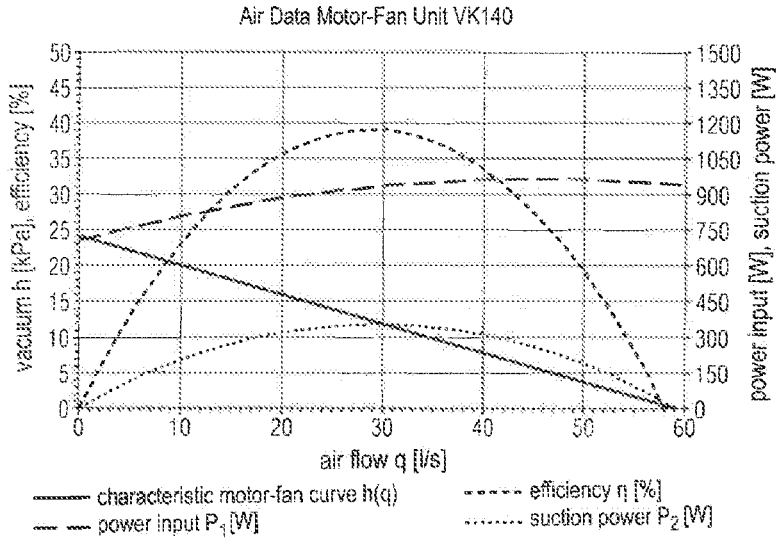
FIGS. 2*a*-2*c*: show air data for a motor-fan unit and a hand-held vacuum cleaning system according to prior art.

Table 1 also shows the characteristic data for further average power input of this motor-fan unit, namely for 425 W, 501 W, 665 W and 825 W. Table 1 also shows specific air data for the motor-fan unit used in the hand-held vacuum cleaning device according to prior art (see also FIG. 2*a*).

TABLE 1

Specific air data for the motor-fan unit (invention and prior art)

| | | | Domel KA 467.3.601-4 | | | | | original motor Vorwerk |
|---|---|---|---|---|---|---|---|---|
| specific values | Average power input | $P_{1m}$ [W] | 340 | 425 | 501 | 665 | 825 | 890 |
| | max. vacuum box | $h_{max}$ [kPa] | 11.8 | 14.0 | 15.7 | 19.1 | 22.0 | 24.2 |
| | max. air flow | $q_{max}$ [l/S] | 53.8 | 59.3 | 63.7 | 70.8 | 77.2 | 58.8 |
| | max. suction | $P_{2max}$ [W] | 157 | 206 | 249 | 337 | 424 | 356 |
| | max. efficiency | $\eta_{max}$ [%] | 40.5 | 42.3 | 43.3 | 44.4 | 44.6 | 39.1 |

When comparing the motor-fan unit from Domel with low average power input of 500 W with the motor-fan unit therebelow used in prior art, it is evident that it generates a lower negative pressure and a lower maximum suction power than the prior art unit at a similar maximum air flow and a similar maximum efficiency. The Domel motor-fan units being operated at a mains voltage at which an average power input of 600 W results, however, show a significantly higher maximum air flow than the unit employed by Vorwerk.

4. Hand-Held Vacuum Cleaning Devices as Particularly Advantageous Results of the Optimization Method According to the Invention FIG. 9*a* to FIG. 9*g* show the schematic design of hand-held vacuum cleaning devices that have shown to be particularly advantageous from the optimization method of the invention.

Figure 1C:
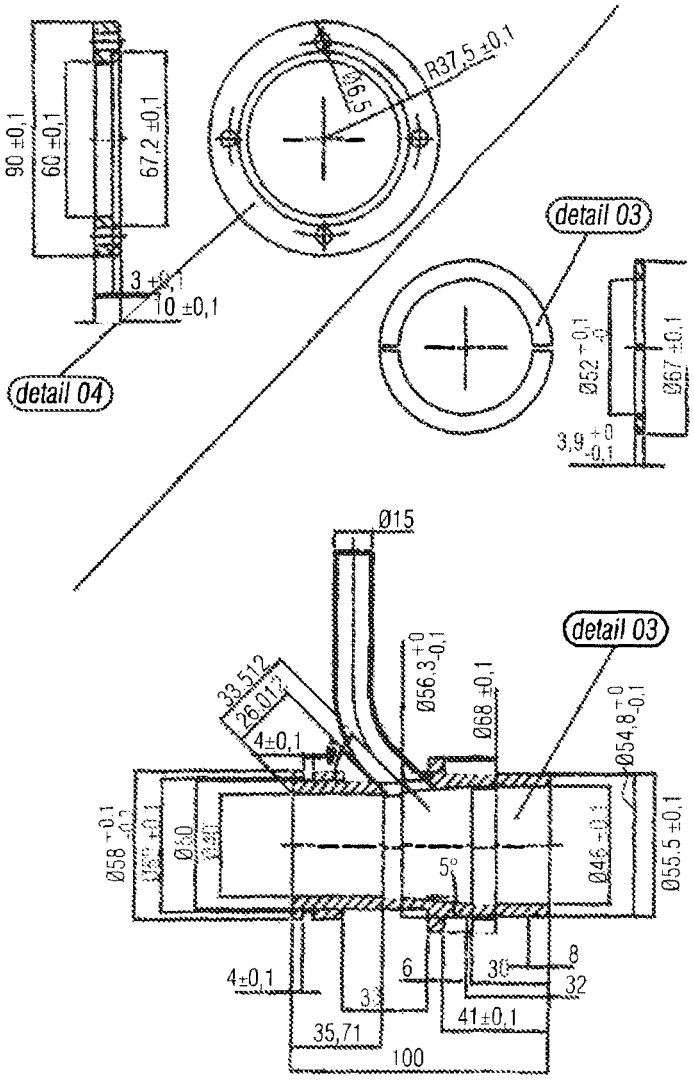
Figure 1D:
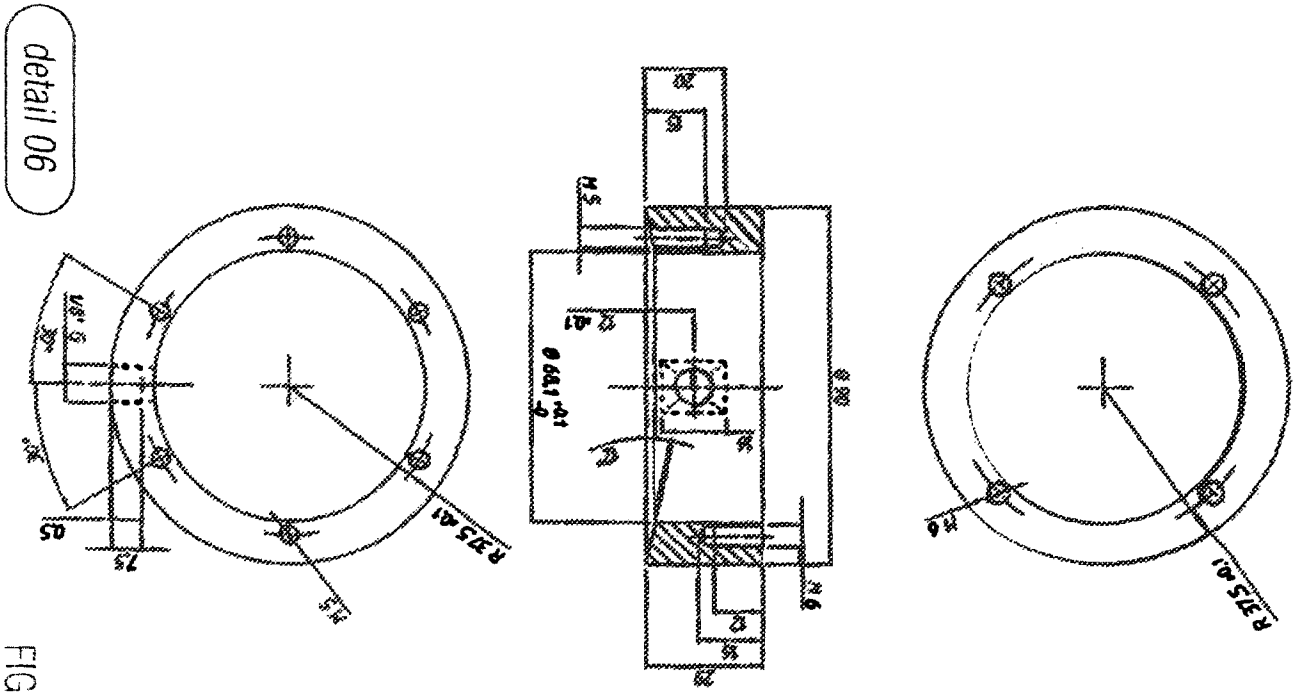
Figure 9A:
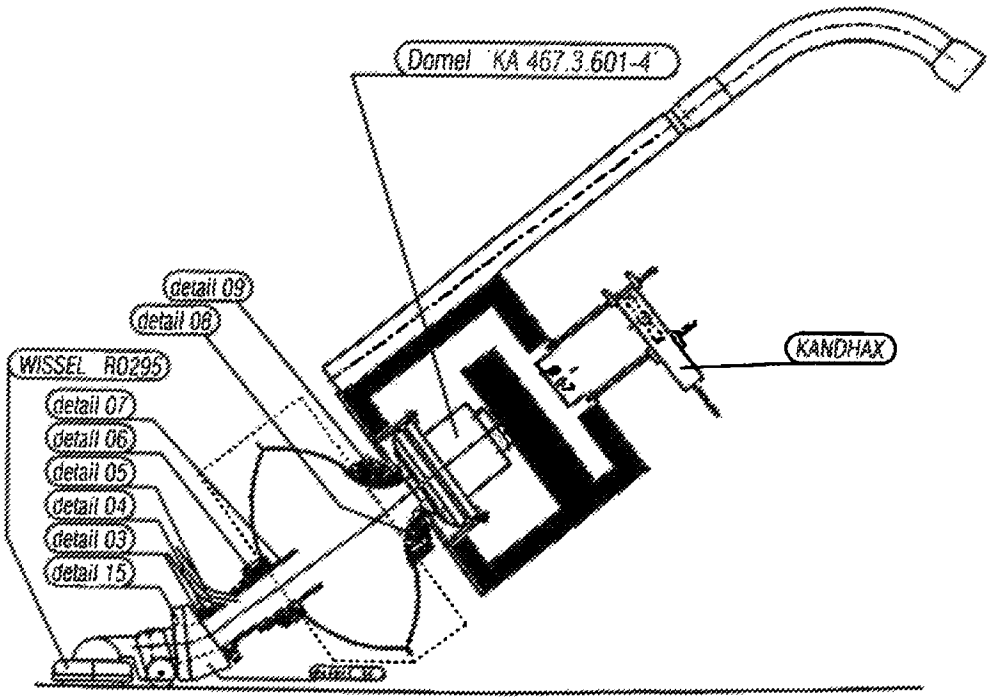
FIG. 9*a*-9*g*: show schematic views of an embodiment of the substantially hoseless and tubeless vacuum cleaning device that results from the application of the method according to the invention.
Figure 9B:
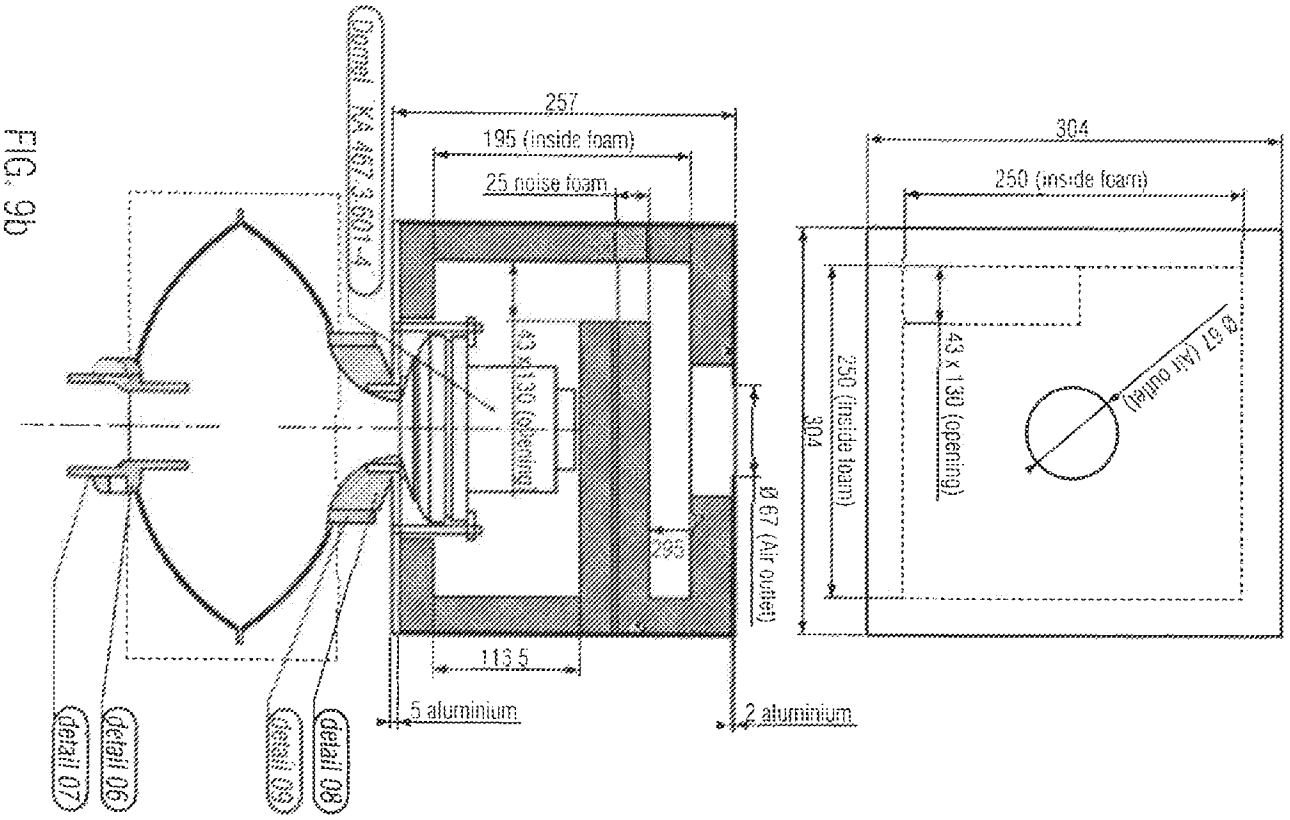
Figure 9C:
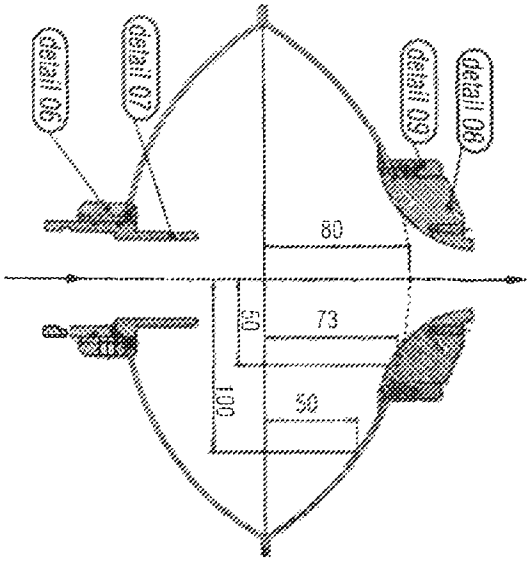

FIG. 9*a*, FIG. 9*b* and FIG. 9*c* show in particular the filter bag receptacle (see also FIG. 4 to FIG. 7). As shown in FIG. 9*c*, this filter bag receptacle is provided with a connection member which is already shown in detail in FIG. 1*e*. The cleaning head is connected to this connection member via the connection members "detail 03", "detail 04" and "detail 05" shown in FIG. 1*c* and the adapters "detail 14" and "detail 15" shown in FIG. 9*f* and FIG. 9*g*.

Figure 1E:
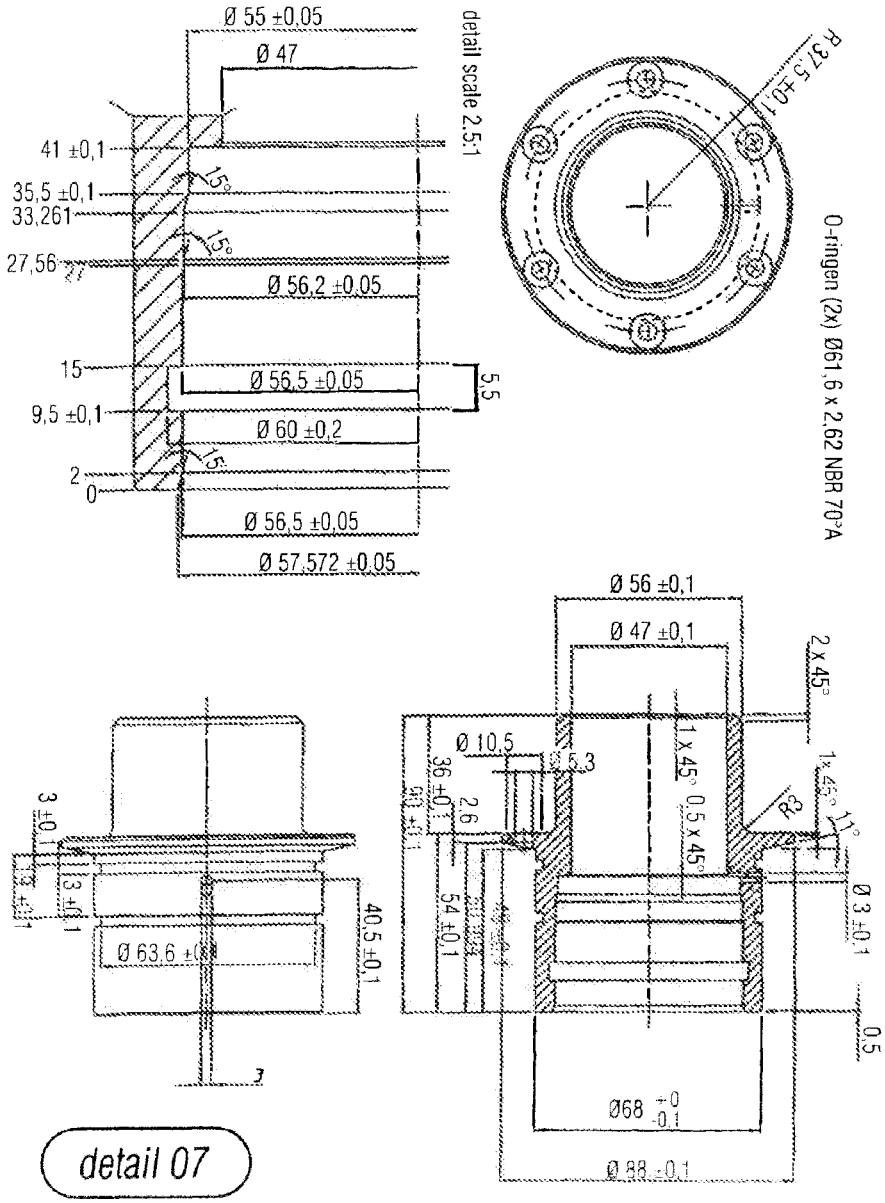
Figure 1F:
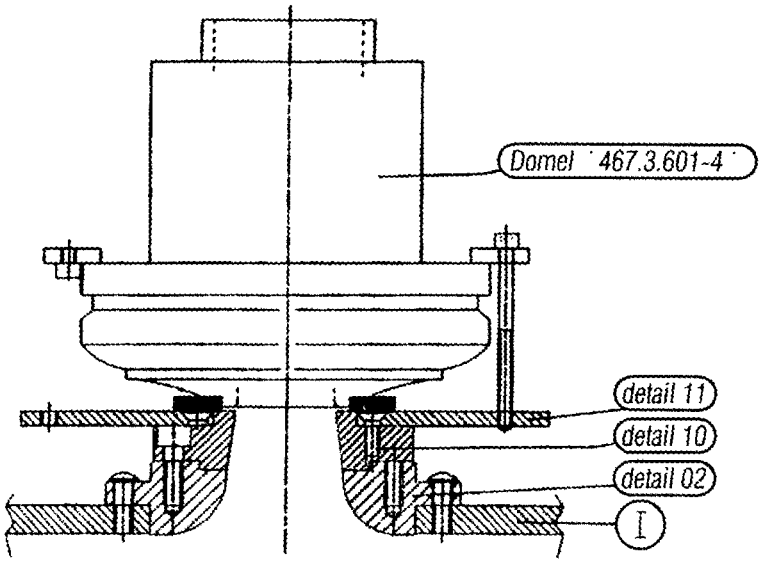
Figure 1G:
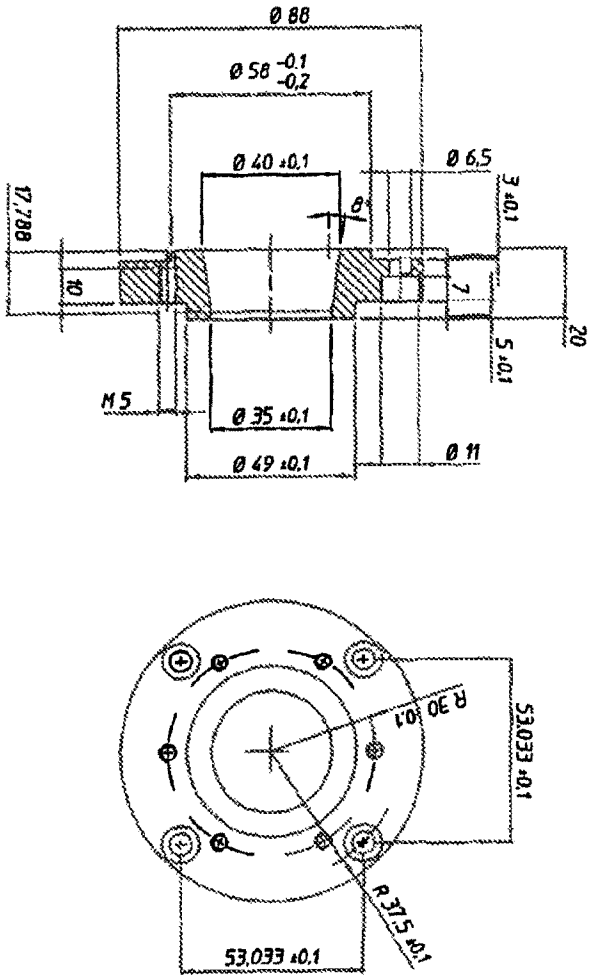
Figure 1H:
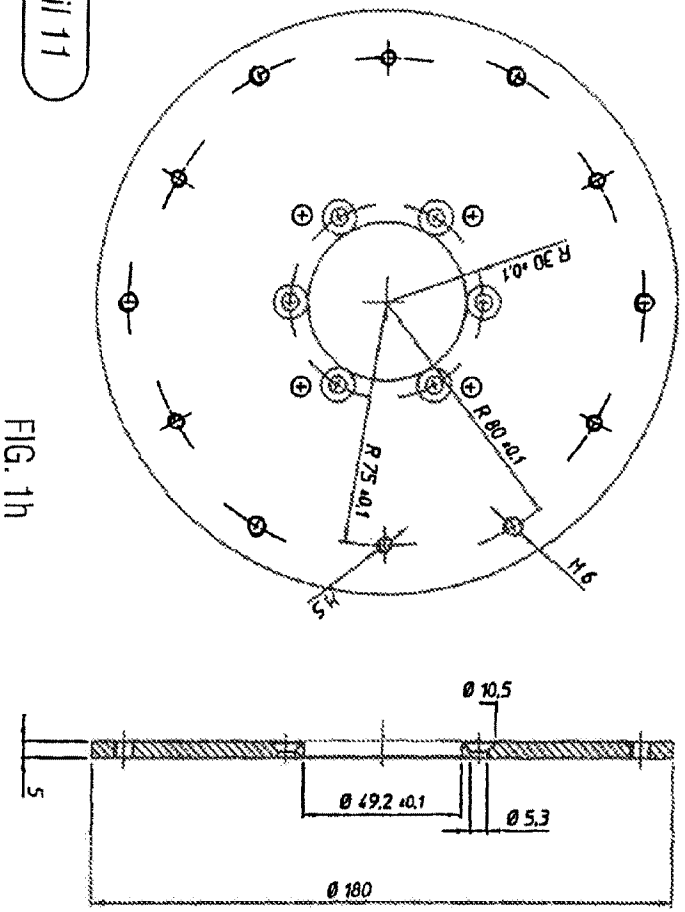
Figure 11:
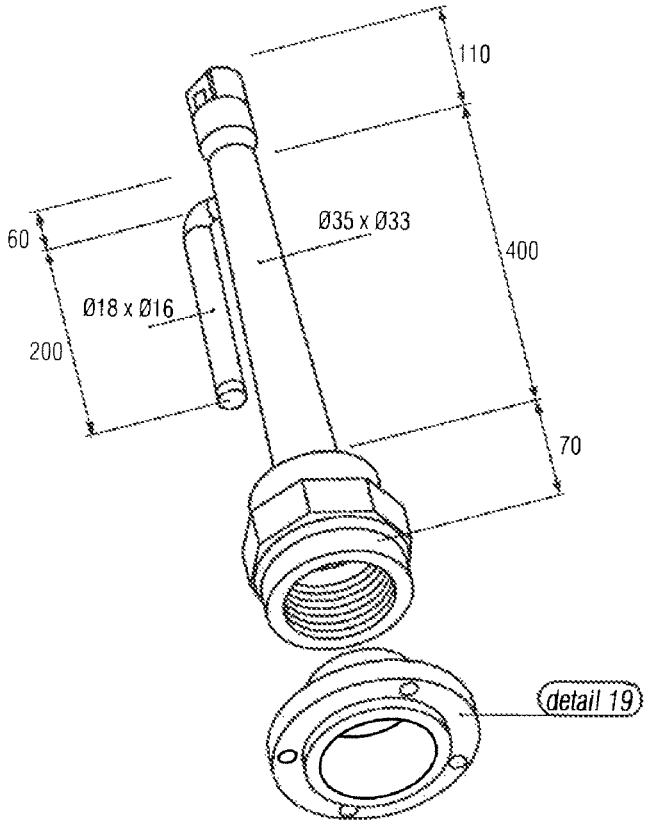
Figure 1J:
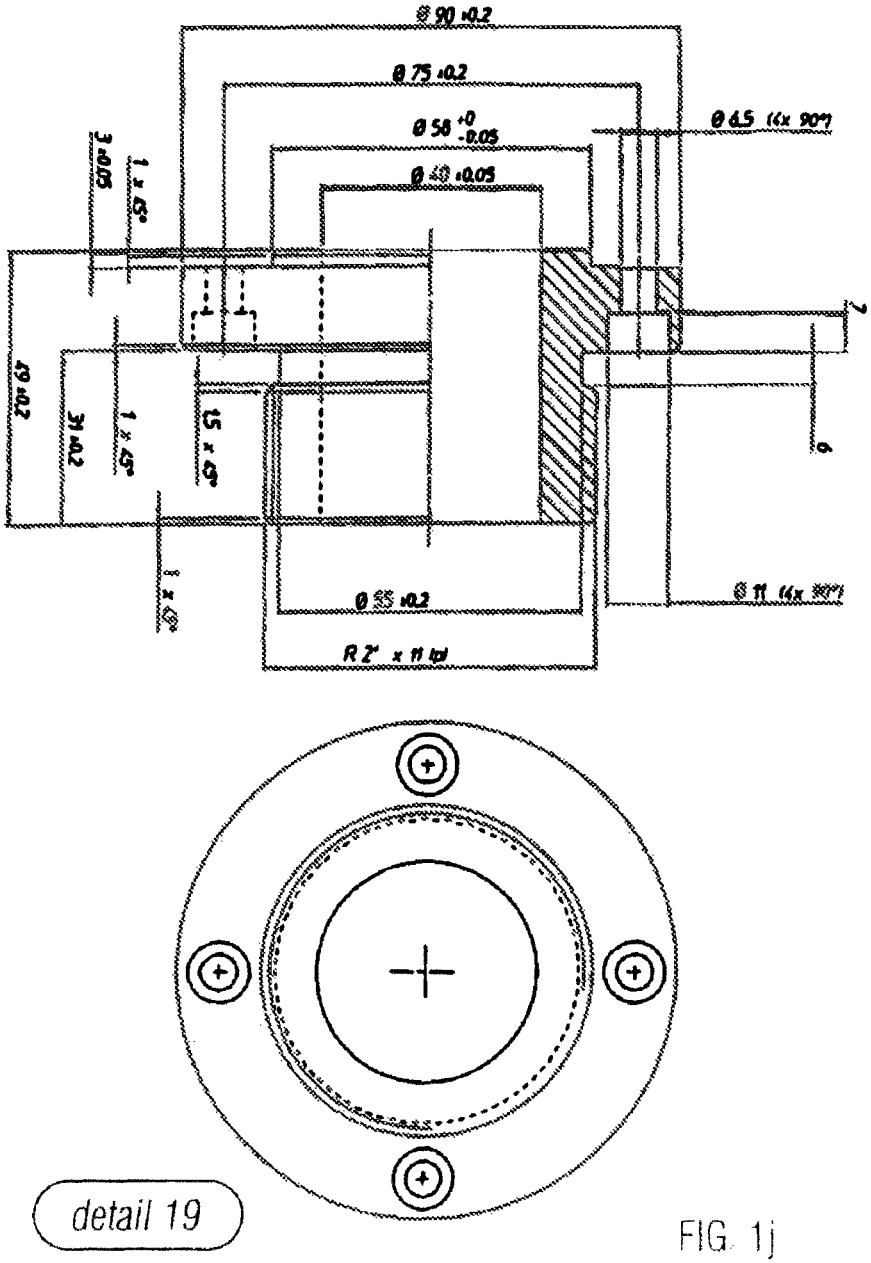

The upper part of the connection member according to FIG. 1*e* is the connection port for the filter bag. The support plate and the inlet port of the filter bag are to be adapted thereto such that the filter bag can be inserted into the filter bag receptacle in an airtight manner.

Figure 9D:
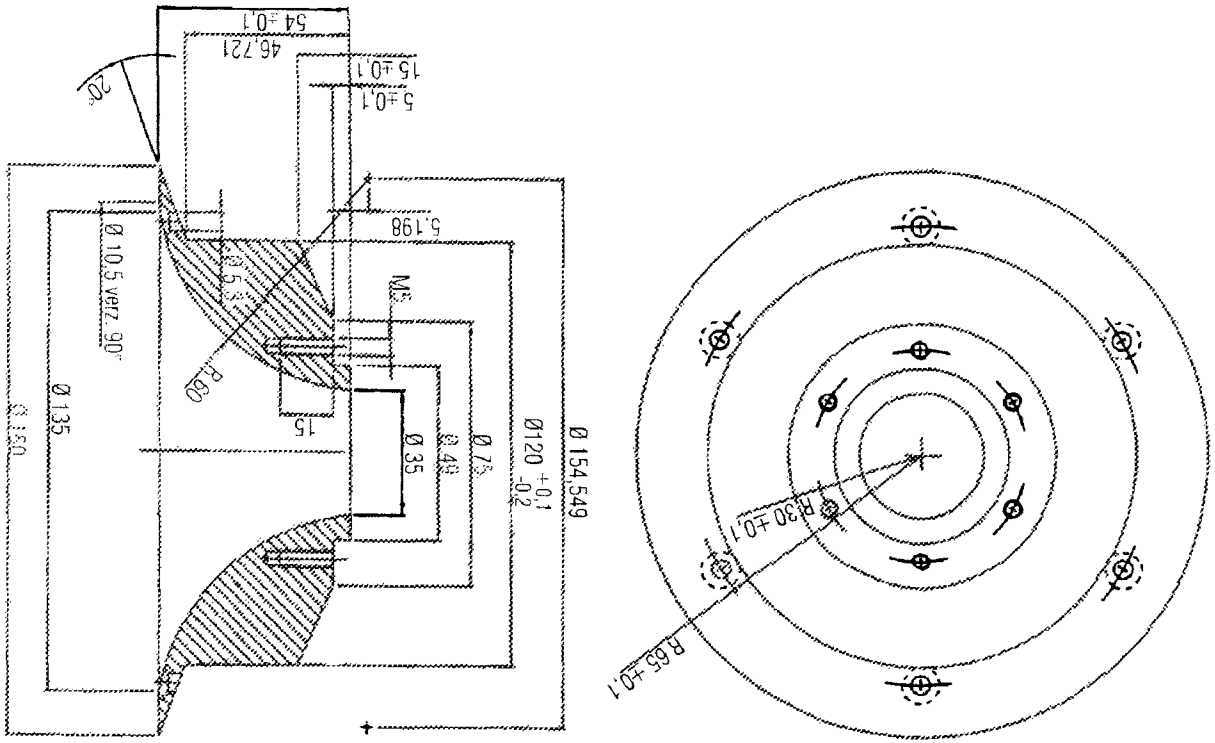
Figure 9E:
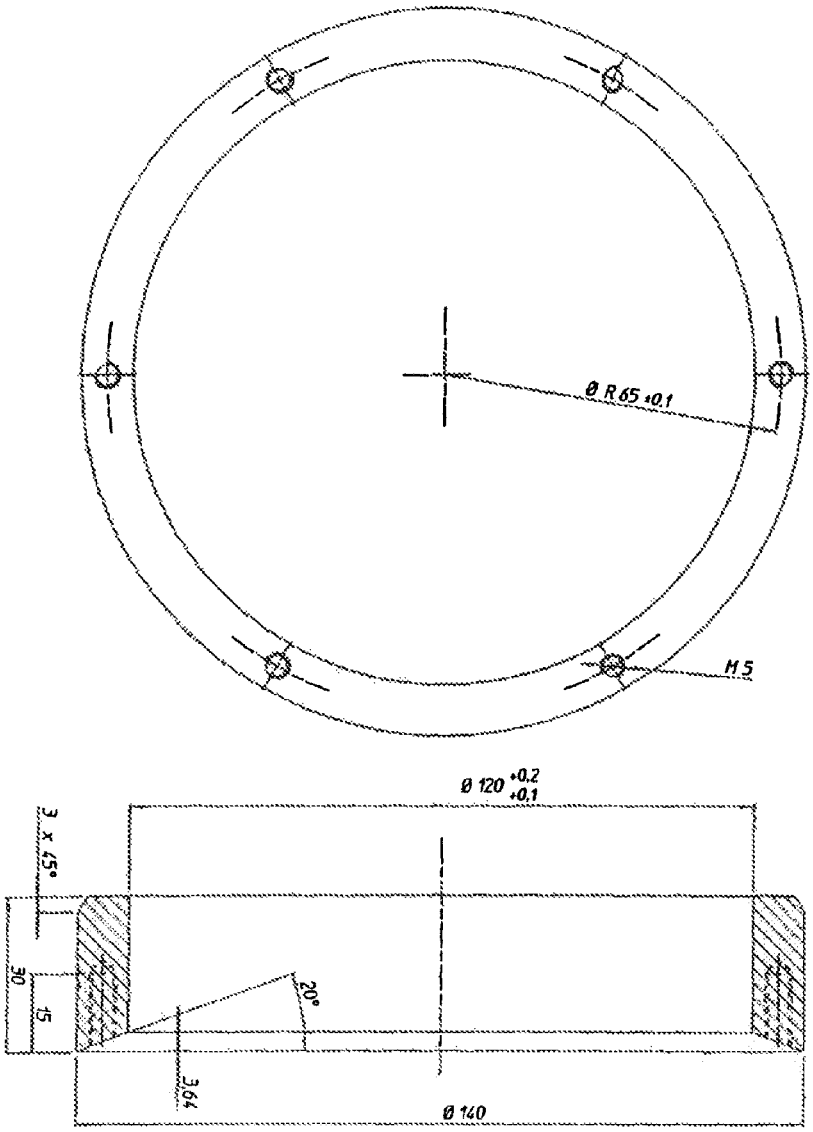
Figure 9F:
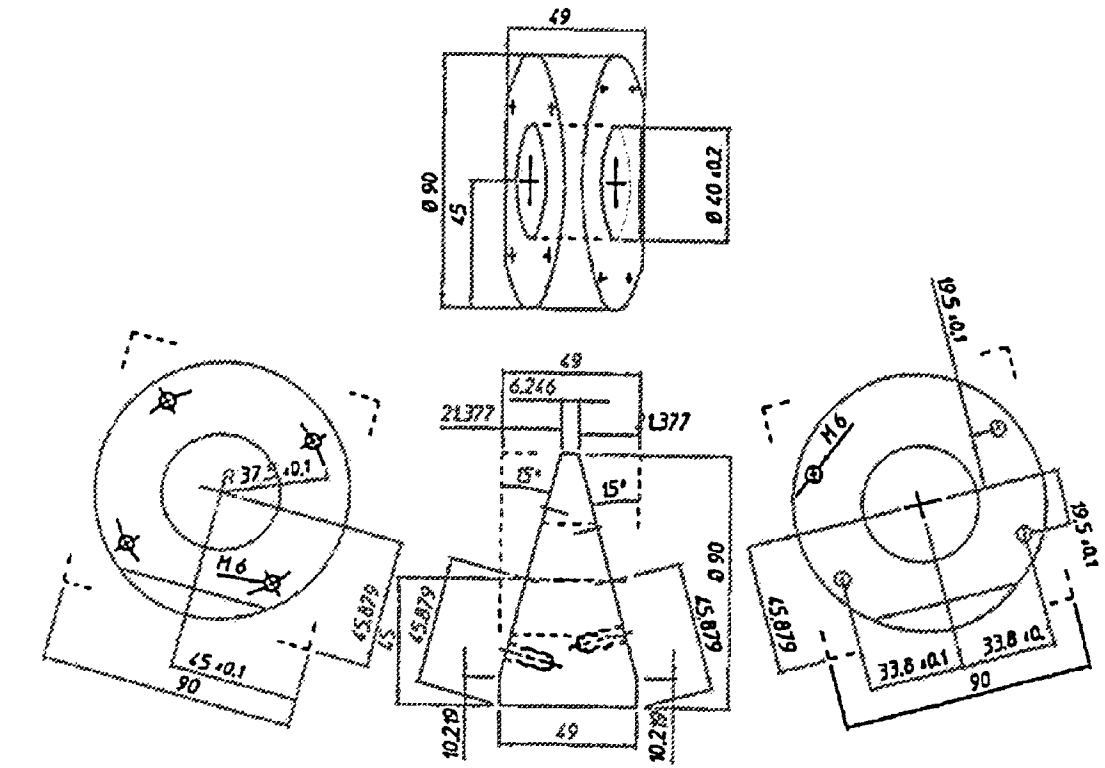
Figure 9G:
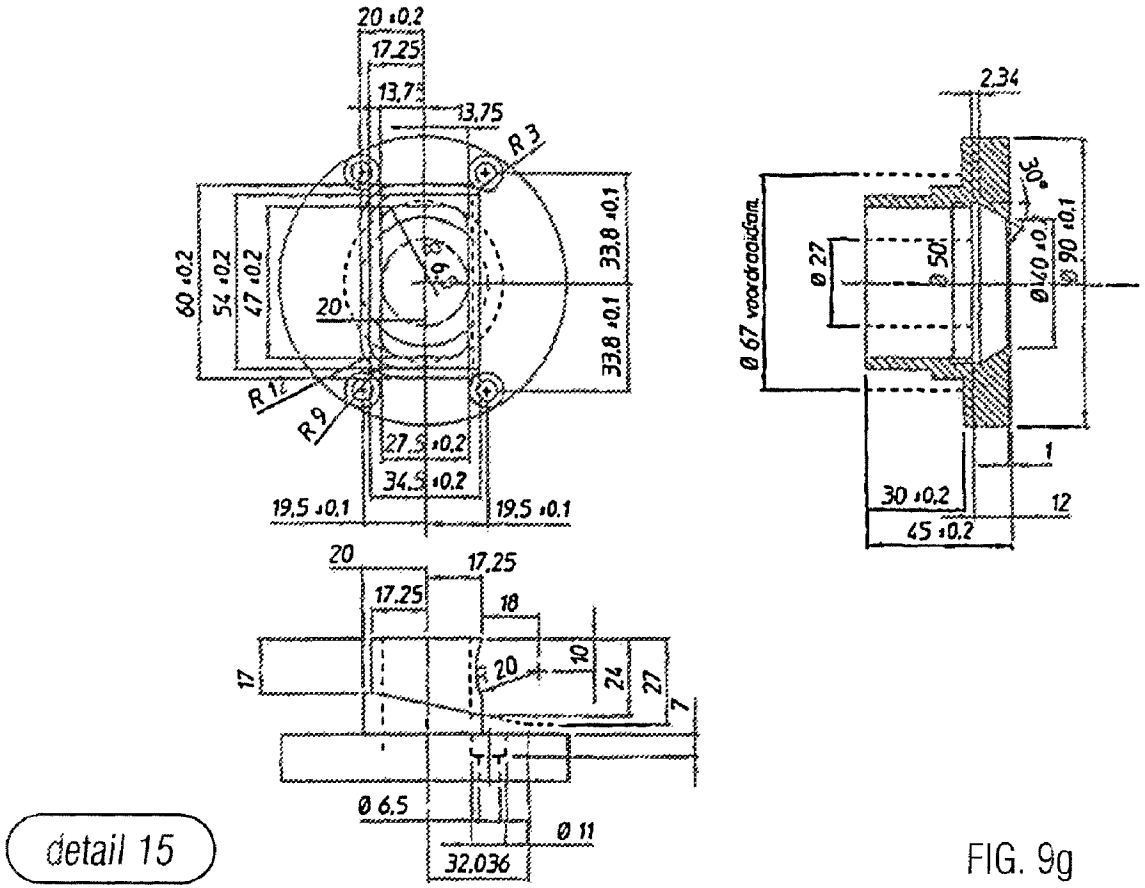

As is also apparent from FIG. 9*c*, connecting the filter bag receptacle to the motor-fan unit is effected via the connection member illustrated in detail in FIGS. 9*d* and 9*e*.

The motor-fan unit is installed in a sound-absorbing housing (see FIG. 9*a* and FIG. 9*b*). The design of the sound-absorbing housing arises from FIG. 9*b*. The plate of the sound-absorbing housing, on which the motor-fan unit is attached, is made of aluminum having a thickness of 5 mm. Aluminum plates having a thickness of 2 mm were used for the remaining plates of the sound-absorbing housing. This housing (except for the openings shown in FIG. 9*a*) was coated with acoustic foam having a thickness of 25 mm. Such a sound-absorbing assembly is provided in all hand-held vacuum cleaning devices. It goes without saying that the filter bag receptacle and the sound-absorbing assembly with the integrated motor-fan unit is in a series model provided in a single housing having one blow-out opening towards the surrounding. Such a housing was dispensed with for the prototype shown in FIG. 9*a*.

FIG. 1*c*, FIG. 1*e*, FIG. 9*d* to FIG. 9*g* are technical drawings of a specific embodiment of the connection of the filter bag receptacle to the cleaning head and to the motor-fan unit being used in the present invention. These technical drawings enable immediate reproduction of the connection members. In addition to this configuration, any other configurations are possible provided that the inner dimensions for the air ducts are not changed.

Figure 2B:
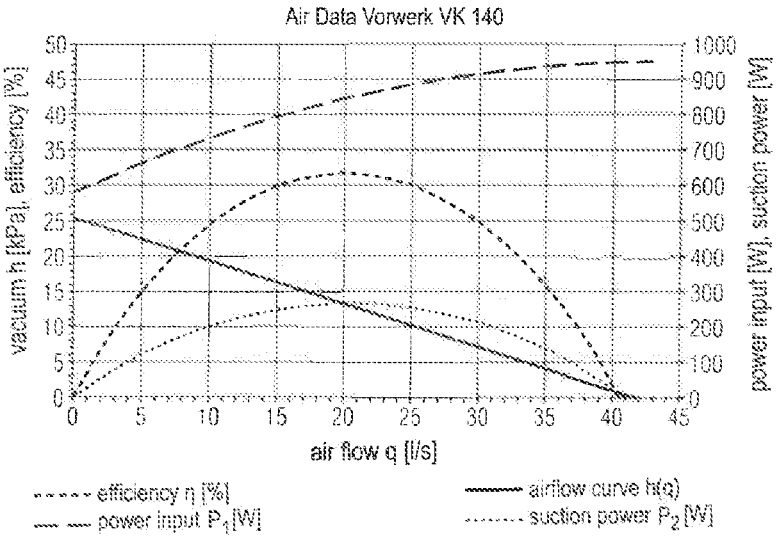
Figure 2C:
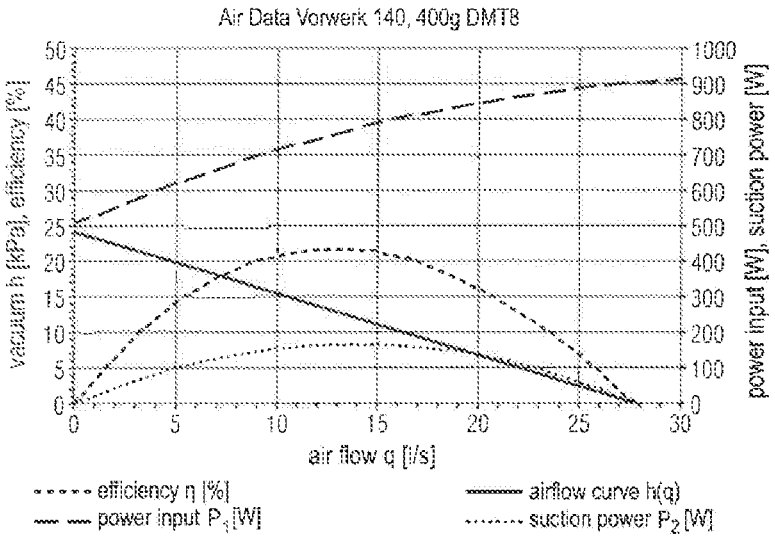
Figure 10B:
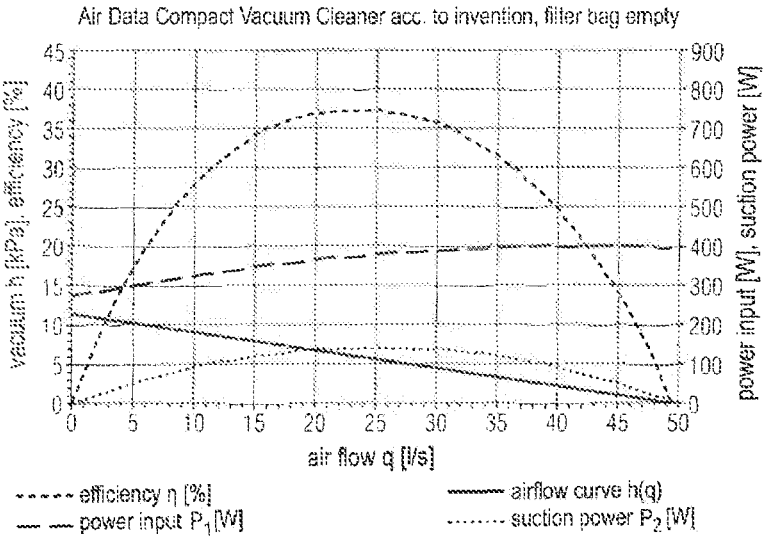
Figure 10C:
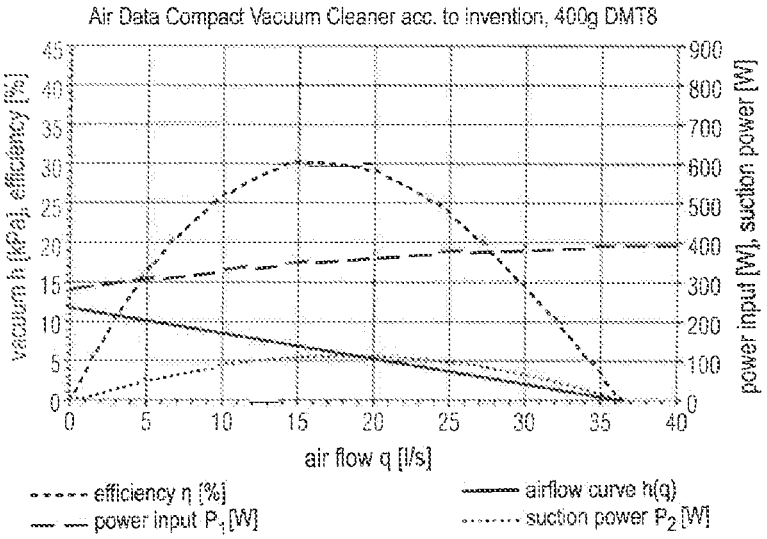

Table 2 shows specific air data as they result in part from FIG. 2*b* for prior art and from FIG. 10*b* according to the invention as previously described. In addition, this table provides specific air data for further embodiments according to the invention for hand-held vacuum cleaning systems, in particular when using motor-fan units having different average power input.

Table 2 in the line "specific values" shows the average power input and the maximum values for the negative pressure, the air flow, the suction power and the efficiency. In addition, the air data is given that arises with orifice size 40 when vacuuming according to the Standard on hard floors (see EN 60312, Section 5.1) and when vacuuming according to the Standard on the Standard carpet type Wilton. In particular the air data for the last two lines is of particular interest for daily use of the vacuum cleaning system.

It is immediately evident from the values in Table 2 that the efficiency for all the hand-held vacuum cleaner according to the invention when vacuuming according to the Standard on the Standard carpet type Wilton is significantly higher than according to prior art. There is an increase over the Vorwerk system of more than 100%.

The efficiency on hard floors is likewise significantly higher for hand-held vacuum cleaning systems according to the invention than for the hand-held prior art vacuum cleaning systems. In other words, the electric power used in the vacuum cleaning systems according to the invention is more efficiently converted to suction power which enables achieving the same suction power with a considerably lower electrical power input (for example, similar suction power is achieved with an average electric power input of 386 W on the Wilton with the system according to the invention (filter bag with surface foldings) as with the Vorwerk system using 936 W).

TABLE 2

Specific air data with an empty filter bag (invention and prior art)

| | | | compact vacuum cleaner acc. to the invention, filter bag with surface foldings | | | | compact vacuum cleaner acc. to the invention, filter bag without surface foldings | | | | Vorwerk VK 140 |
|---|---|---|---|---|---|---|---|---|---|---|---|
| specific values | average power input | $P_{1m}$ [W] | 267 | 340 | 425 | 506 | 266 | 347 | 438 | 511 | 768 |
| | max. vacuum box | $h_{max}$ [kPa] | 9.4 | 11.6 | 13.6 | 15.4 | 9.2 | 11.7 | 13.6 | 15.3 | 25.3 |
| | max. air flow | $q_{max}$ [l/s] | 44.4 | 50.4 | 54.6 | 58.3 | 44.4 | 50.1 | 54.4 | 57.3 | 41.7 |
| | max. suction | $P_{2max}$ [W] | 104 | 145 | 186 | 225 | 101 | 146 | 185 | 219 | 270 |
| | max. efficiency | $\eta_{max}$ [%] | 35.8 | 37.8 | 39.2 | 39.7 | 34.8 | 37.6 | 39.3 | 39.5 | 31.8 |
| with | power input | $P_1$ [W] | 303 | 401 | 501 | 600 | 303 | 403 | 504 | 598 | 948 |
| orifice | vacuum box | h [kPa] | 1.5 | 1.9 | 2.3 | 2.6 | 1.5 | 1.8 | 2.2 | 2.5 | 1.9 |
| size | air flow | q [l/s] | 37.5 | 42.2 | 45.7 | 48.7 | 37.0 | 42.3 | 45.7 | 47.9 | 38.6 |
| 40 mm | suction power | $P_2$ [W] | 56 | 79 | 103 | 124 | 58 | 76 | 98 | 119 | 67 |
| | efficiency | $\eta$ [%] | 18.5 | 19.8 | 20.5 | 20.6 | 19.0 | 18.9 | 19.4 | 19.9 | 7.1 |
| with | power input | $P_1$ [W] | 303 | 401 | 500 | 600 | 303 | 402 | 502 | 597 | 947 |
| cleaning | vacuum box | h [kPa] | 1.6 | 2.2 | 2.5 | 2.9 | 1.6 | 2.3 | 2.6 | 2.8 | 2.1 |
| head on | air flow | q [l/s] | 36.7 | 40.7 | 44.6 | 47.2 | 36.6 | 40.0 | 44.0 | 47.0 | 38.2 |
| hard | suction power | $P_2$ [W] | 61 | 90 | 113 | 138 | 60 | 93 | 113 | 129 | 75 |
| floors | efficiency | $\eta$ [%] | 20.1 | 22.5 | 22.5 | 23.0 | 19.8 | 23.2 | 22.6 | 21.6 | 7.9 |
| with | power input | $P_1$ [W] | 291 | 386 | 478 | 570 | 292 | 384 | 470 | 559 | 936 |
| cleaning | vacuum box | h [kPa] | 4.2 | 5.4 | 6.4 | 7.5 | 4.2 | 5.8 | 6.7 | 7.5 | 4.4 |
| head on | air flow | q [l/s] | 24.8 | 26.7 | 28.9 | 29.9 | 24.2 | 25.2 | 27.7 | 29.1 | 34.4 |
| Wilton | Suction power | $P_2$ [W] | 103 | 145 | 186 | 225 | 100 | 146 | 185 | 219 | 151 |
| | efficiency | $\eta$ [%] | 35.3 | 37.5 | 38.8 | 39.5 | 34.4 | 38.1 | 39.4 | 39.2 | 16.2 |

These highly improved results over prior art result from the fact that vacuum cleaning systems according to the invention have no longer been optimized such that maximum suction power is achieved for a given electrical power input, as is common in prior art, but to the extent that the air flow when vacuuming according to the Standard on the Standard carpet type Wilton is as high as possible.

Table 3 corresponds to Table 2, except that no empty filter bag was inserted into the hand-held vacuum cleaning device but a filter bag filled with 400 g of DMT8 Standard dust. The differences between the hand-held vacuum cleaning systems of prior art and according to the invention are here even greater than in the case of the empty filter bag.

This means that vacuum cleaning systems according to the invention are far superior not only just after replacement of the filter bag, but that the power loss during the vacuuming operation, i.e. when filling the filter bag, is also lower. The service life of the vacuum cleaning systems according to the invention is therefore longer than the service life of the system according to prior art.

TABLE 3

Specific air data for a filter bag filled with 400 g of DMT8 dust (invention and prior art)

| | | | compact vacuum cleaner acc. to the invention, filter bag with surface foldings | | | | compact vacuum cleaner acc. to the invention, filter bag without surface foldings | | | | Vorwerk VK 140 |
|---|---|---|---|---|---|---|---|---|---|---|---|
| specific values | average power input | $P_{1m}$ [W] | 261 | 340 | 427 | 506 | 256 | 341 | 429 | 439 | 710 |
| | max. vacuum box | $h_{max}$ [kPa] | 9.5 | 12.0 | 13.9 | 16.1 | 9.6 | 12.0 | 13.8 | 15.6 | 24.0 |
| | max. air flow | $q_{max}$ [l/s] | 34.7 | 36.0 | 42.9 | 44.9 | 31.7 | 36.0 | 40.2 | 42.0 | 27.9 |
| | max. suction power | $P_{2max}$ [W] | 83 | 108 | 149 | 181 | 76 | 108 | 138 | 164 | 169 |
| | max. efficiency | $\eta_{max}$ [%] | 30.3 | 30.4 | 33.3 | 33.4 | 28.9 | 30.8 | 31.0 | 31.6 | 21.8 |
| with | power input | $P_1$ [W] | 295 | 393 | 493 | 593 | 291 | 392 | 495 | 573 | 903 |
| orifice | vacuum box | h [kPa] | 1.2 | 1.3 | 1.7 | 1.9 | 1 0 | 1.3 | 1.5 | 1.7 | 1.0 |
| size | air flow | q [l/s] | 30.2 | 32.2 | 37.7 | 39.7 | 28.5 | 32.1 | 35.8 | 37.3 | 26.8 |
| 40 mm | suction power | $P_2$ [W] | 37 | 40 | 64 | 74 | 28 | 42 | 55 | 64 | 25 |
| | efficiency | $\eta$ [%] | 12.6 | 10.2 | 12.9 | 12.5 | 9.5 | 10.7 | 11.1 | 11.3 | 2.8 |
| with | power input | $P_1$ [W] | 296 | 396 | 495 | 595 | 291 | 394 | 497 | 575 | 903 |
| cleaning | vacuum box | h [kPa] | 0.7 | 0.4 | 1.0 | 1.1 | 0.8 | 0.8 | 1.1 | 0.8 | 1.0 |

TABLE 3-continued

Specific air data for a filter bag filled with 400 g of DMT8 dust (invention and prior art)

| | | | compact vacuum cleaner acc. to the invention, filter bag with surface foldings | | | | compact vacuum cleaner acc. to the invention, filter bag without surface foldings | | | | Vorwerk VK 140 |
|---|---|---|---|---|---|---|---|---|---|---|---|
| head on hard floors with cleaning head on Wilton | air flow | q [l/s] | 32.3 | 34.7 | 39.9 | 41.8 | 29.0 | 33.5 | 37.0 | 39.8 | 26.8 |
| | suction power | $P_2$ [W] | 21 | 14 | 39 | 47 | 24 | 28 | 42 | 31 | 25 |
| | efficiency | η [%] | 7.1 | 3.6 | 8.0 | 7.9 | 8.2 | 7.1 | 8.5 | 5.4 | 2.8 |
| | power input | $P_1$ [W] | 289 | 381 | 472 | 569 | 283 | 375 | 473 | 552 | 895 |
| | vacuum box | h [kPa] | 3.1 | 3.8 | 5.1 | 6.3 | 3.2 | 4.0 | 4.6 | 5.5 | 2.2 |
| | air flow | q [l/s] | 23.4 | 24.8 | 27.1 | 27.5 | 21.2 | 23.9 | 26.9 | 27.3 | 25.4 |
| | suction power | $P_2$ [W] | 72 | 93 | 139 | 172 | 67 | 96 | 123 | 150 | 55 |
| | efficiency | η [%] | 25.0 | 24.4 | 29.4 | 30.2 | 23.8 | 25.7 | 25.9 | 27.1 | 6.2 |

Tables 4 and 5 show the losses that arise when the motor-fan unit is incorporated into a hand-held vacuum cleaning device; in Table 4 for the hand-held vacuum cleaning device with an empty filter bag and in Table 5 for the hand-held vacuum cleaning device with a vacuum cleaner bag filled with 400 g of DMT8 Standard dust.

It arises immediately from Table 4 that the characteristic losses of the motor-fan unit used in the vacuum cleaning devices are for the vacuum cleaning devices according to the invention much lower than for prior art. The characteristic losses are the losses for the maximum air flow, for the maximum suction power and for the maximum efficiency. The maximum negative pressure changes only slightly in both the system according to the invention as well as in the system according to prior art. Whereas the power input in the system according to the invention hardly changes, it drops in the Vorwerk system.

This shows that also the adaptation of the motor-fan unit to the other components of the vacuum cleaning system contributes to the superiority of these systems in the system according to the invention over prior art.

TABLE 4

Losses due to the installation of the motor-fan units into the vacuum cleaner with empty filter bag (invention and prior art)

| | | | compact vacuum cleaner acc. to the invention, filter bag with surface foldings | | | compact vacuum cleaner acc. to the invention, filter bag without surface foldings | | | Vorwerk VK140 |
|---|---|---|---|---|---|---|---|---|---|
| losses (measurement values vacuum cleaner minus measurement values motor) | Δ average power input | $\Delta P_{1m}$ [W] | 0 | 0 | 6 | 7 | 14 | 11 | −122 |
| | Δ max. vacuum box | $\Delta h_{max}$ [kPa] | −0.3 | −0.4 | −0.3 | −0.2 | −0.4 | −0.5 | 1.1 |
| | Δ max. air flow | $\Delta q_{max}$ [l/s] | −3.5 | −4.4 | −5.4 | −3.8 | −4.9 | −6.3 | −17.1 |
| | Δ max. suction power | $\Delta P_{2max}$ [W] | −12 | −20 | −24 | −11 | −21 | −30 | −86 |
| | Δ max. efficiency | $\Delta \eta_{max}$ [%] | −2.7 | −3.0 | −3.6 | −2.8 | −2.9 | −3.9 | −7.3 |
| losses in percent | power input | $\Delta P_{1m}$ [W] | 0 | 0 | 1 | 2 | 3 | 2 | −14 |
| | Δ max. vacuum box | $\Delta h_{max}$ [kPa] | −2.2 | −3.2 | −1.8 | −1.4 | −3.1 | −2.9 | 4.5 |
| | Δ max. air flow | $\Delta q_{max}$ [l/s] | −6.4 | −7.5 | −8.4 | −7.0 | −8.3 | −9.9 | −29.1 |
| | Δ max. suction power | $\Delta P_{2max}$ [W] | −7 | −10 | −10 | −7 | −10 | −12 | −24 |
| | Δ max. efficiency | $\Delta \eta_{max}$ [%] | −6.6 | −7.2 | −8.3 | −7.0 | −6.9 | −8.9 | −18.7 |

The same can also be gathered from Table 5. This means that the motor-fan units of the vacuum cleaning systems according to the invention are better adapted to the other components of the system not only with a filter bag just replaced, but that this behavior is ensured also during vacuuming, i.e. when filling the filter bag.

TABLE 5

Losses due to the installation of the motor-fan units into the vacuum cleaner with a filter bag filled with 400 g of DMT8 dust (invention and prior art)

| | | | Compact vacuum cleaner acc. to the invention, filter bag with surface foldings | | | Compact vacuum cleaner acc. to the invention, filter bag without surface foldings | | | Vorwerk VK140 |
|---|---|---|---|---|---|---|---|---|---|
| losses (measurement values vacuum cleaner minus measurement values motor)) | Δ average power input | Δ $P_{1m}$ [W] | 0 | 2 | 6 | 1 | 4 | −11 | −180 |
| | Δ max. vacuum box | Δ $h_{max}$ [kPa] | 0.2 | −0.1 | 0.4 | 0.1 | −0.2 | −0.1 | −0.2 |
| | Δ max. air flow | Δ $q_{max}$ [l/S] | −17.8 | −16.4 | −18.8 | −17.8 | −19.1 | −21.7 | −30.9 |
| | Δ max. suction | Δ $P_{2max}$ [W] | −49 | −57 | −68 | −49 | −68 | −85 | −188 |
| | Δ max. efficiency | Δ $\eta_{max}$ [%] | −10.0 | −9.0 | −9.9 | −9.7 | −11.3 | −11.7 | −17.3 |
| losses in percent | Δ average power input | Δ $P_{1m}$ [W] | 0 | 0 | 1 | 0 | 1 | −2 | −20 |
| | Δ max. vacuum box | Δ $h_{max}$ [kPa] | 1.8 | −0.5 | 2.6 | 1.2 | −1.2 | −05 | −0.7 |
| | Δ max. air flow | Δ $q_{max}$ [l/S] | −33.1 | −27.7 | −29.5 | −33.0 | −32.2 | −34.1 | −52.5 |
| | Δ max. suction power | Δ $P_{2max}$ [W] | −31 | −28 | −27 | −31 | −33 | −34 | −53 |
| | Δ max. efficiency | Δ $\eta_{max}$ [%] | −24.8 | −21.3 | −22.9 | −24.0 | −26.6 | −27.1 | −44.3 |

The results for the hand-held vacuum cleaning system signify that, for a compact vacuum cleaning system being composed of the same components, the results for such a system will be even better than for a corresponding hand-held vacuum cleaning system, because the compact vacuum cleaning system for reasons of design has a shorter connection provided between the cleaning head and the filter bag receptacle, so that the throttle by the connection between the cleaning head and filter bag receptacle effect can again be reduced.

Since the substantially hoseless and tubeless upright vacuum cleaning system compared to hand-held vacuum cleaning systems have only a slightly longer connection between the cleaning head and filter bag receptacle, the values for such upright vacuum cleaning systems will be only slightly worse than for the hand-held vacuum cleaning system so that a significant improvement can still be achieved over prior art.

The invention claimed is:

1. A method for optimizing a vacuum cleaning system with a substantially hoseless and tubeless vacuum cleaning device and a filter bag, wherein said substantially hoseless and tubeless vacuum cleaning device comprises a motor-fan unit having a characteristic motor-fan curve, a filter bag receptacle, a connection port for said filter bag and a cleaning head, and wherein said filter bag comprises filter material made of nonwoven material, the method comprising:

first determining an air flow curve with the filter bag in the substantially hoseless and tubeless vacuum cleaning device and connected to a measuring box according to Standard EN 60312; and adapting said characteristic motor-fan curve, wherein the motor-fan unit is employed for said adaptation whose characteristic motor-fan curve is provided such that with orifice size 0, a negative pressure of between 6 kPa and 23 kPa and a maximum air flow of at least 40 l/s are generated, and adapting a size, a shape and a material of said filter bag and adapting a size and a shape of said filter bag receptacle and adapting an inner diameter of said connection port for said filter bag and adapting said cleaning head to each other such that said vacuum cleaning system achieves an efficiency of at least 30% when vacuuming according to a Standard on a Standard carpet type Wilton with an empty filter bag, where vacuuming according to said Standard is performed according to Standard EN 60312 and said Standard carpet type Wilton is provided according to Standard EN 60312.

2. The method according to claim 1, wherein the adaptation further leads to achieving an efficiency of at least 20% arising when vacuuming on said Standard carpet type Wilton when said vacuum cleaning system is filled according to said Standard with 400 g of DMT8 Standard dust, where said DMT8 Standard dust is provided in accordance with Standard EN 60312.

3. The method according to claim 1, wherein said adaptation leads to an efficiency reduction between a maximum efficiency of said motor-fan unit and a maximum efficiency of said vacuum cleaning system with an empty filter bag and without a cleaning head amounting to less than 15%.

4. The method according to claim 1, wherein said adaptation further leads to an efficiency reduction between a maximum efficiency of said motor-fan unit and a maximum efficiency of said vacuum cleaning system with a filter bag filled with 400 g of DMT8 Standard dust and without a cleaning head amounting to less than 40%.

5. The method according to claim 1, wherein said adaptation further leads to a suction power of said vacuum cleaning system amounting to at least 100 W, when vacuuming according to said Standard on said Standard carpet type Wilton with an empty filter bag.

6. The method according to claim 1, wherein said adaptation further leads to a suction power of said vacuum cleaning system amounting to at least 70 W when vacuuming according to said Standard on said Standard carpet type Wilton with a filter bag filled with 400 g of DMT8 Standard dust.

7. The method according to claim 1, wherein said adaptation further leads to an air flow amounting to at least 20 l/s when vacuuming according to said Standard on said Standard carpet type Wilton with an empty filter bag.

8. The method according to claim 1, wherein said adaptation further leads to an air flow amounting to at least 20 l/s when vacuuming according to said Standard on said Standard carpet type Wilton with a filter bag filled with 400 g of DMT8 Standard dust.

9. The method according to claim 1, wherein a filter bag in a shape of a flat bag with a first and a second filter bag wall is used for said adaptation, where said first or second filter bag wall comprises at least five folds, where said at least five folds form at least one surface folding whose maximum height prior to a first use of said filter bag in a substantially hoseless and tubeless vacuum cleaning device is less than a maximum width corresponding to a maximum height.

10. The method according to claim 9, wherein each fold, prior to the first use of the filter bag in a substantially hoseless and tubeless vacuum cleaning device, has a length corresponding to at least half of a total dimension of said filter bag in a direction of said fold.

11. The method according to claim 9, wherein each fold of said employed flat bag, prior to the first use of said filter bag in a substantially hoseless and tubeless vacuum cleaning device, has a fold height between 3 mm and 50 mm.

12. The method according to claim 9, wherein each surface folding of said employed filter bag comprises portions that are located in a surface of said filter bag wall, and comprises portions that project over the surface of said filter bag wall and can be folded apart during the vacuuming operation, wherein said substantially hoseless and tubeless vacuum cleaning device comprises a filter bag receptacle with rigid walls, wherein at least one first spacing device is provided on said walls of said filter bag receptacle such that the at least one first spacing device holds said portions of at least one surface folding located in the surface of said filter bag wall spaced from said wall of said filter bag receptacle, and at least one second spacing device is provided in such a manner that the at least one second spacing device holds said unfolded portions of said at least one surfaces fold spaced from said wall of said filter bag receptacle.

13. The method according to claim 12, wherein a height of said first or said second spacing device relative to said wall of said filter bag receptacle lies in a range of 5 mm to 60 mm.

14. The method according to claim 1, wherein a motor-fan unit is employed for said adaptation whose characteristic motor-fan curve is provided such that with orifice size 0 negative pressure of between 6 kPa and 23 kPa and a maximum air flow of at least 50 l/s are generated.

15. The method according to claim 1, wherein a filter bag in a shape of a flat bag is used for said adaptation, and a substantially hoseless and tubeless vacuum cleaning device with a filter bag receptacle having rigid walls is used, wherein said filter bag receptacle comprises an opening having a predetermined opening surface that is closeable with a flap through which said filter bag is inserted into said filter bag receptacle, and wherein a ratio of a rectangle corresponding to an area of said opening surface and an area of said filter bag is greater than 1.0.

16. The method according to claim 15, wherein the ratio of the surface of said filter bag receptacle and the surface of said filter bag is greater than 0.90.

17. The method according to claim 1, wherein a filter bag in a shape of a flat bag is used for said adaptation, and a substantially hoseless and tubeless vacuum cleaning device with a filter bag receptacle having rigid walls is used, wherein a ratio of a usable volume of said filter bag in said filter bag receptacle to a maximum usable volume of said filter bag is greater than 0.70.

18. The method according to claim 1, wherein components are adapted to each other such that an air flow curve with an empty filter bag results in which with orifice size 0 negative pressure of between 8 kPa and 20 kPa and a maximum air flow of at least 40 l/s are generated.

19. The method according to claim 1, wherein components are adapted to each other such that an air flow curve with a filter bag filled with 400 g of DMT8 dust results in which with orifice size 0 negative pressure of between 8 kPa and 20 kPa and a maximum air flow of at least 30 l/s are generated.

20. The method according to claim 1, wherein an inner diameter of said connection port is selected such that the inner diameter is larger than a smallest inner diameter of said connection of said tube or said hose.

21. A vacuum cleaning system comprising a substantially hoseless and tubeless vacuum cleaning device and a filter bag, where said substantially hoseless and tubeless vacuum cleaning device comprises a motor-fan unit having a characteristic motor-fan curve, a filter bag receptacle, a connection port for said filter bag and a cleaning head, and where said filter bag comprises filter material made of nonwoven material, wherein development or manufacture of said system is performed by first determining an air flow curve with the filter bag in the substantially hoseless and tubeless vacuum cleaning device and connected to a measuring box according to EN 60312; and adapting said characteristic motor-fan curve, wherein the motor-fan unit is employed for said adaptation whose characteristic motor-fan curve is provided such that with orifice size 0, a negative pressure of between 6 kPa and 23 kPa and a maximum air flow of at least 40 l/s are generated, and a size, a shape and a material of said filter bag and a size and a shape of said filter bag receptacle and an inner diameter of said connection port for said filter bag and said cleaning head to each other such that said vacuum cleaning system achieves an efficiency of at least 30% when vacuuming according to a Standard on a Standard carpet type Wilton with an empty filter bag, where vacuuming according to said Standard is performed according to Standard EN 60312 and said Standard carpet type Wilton is provided according to Standard EN 60312.

* * * * *